US006196037B1

(12) United States Patent
Urschel et al.

(10) Patent No.: US 6,196,037 B1
(45) Date of Patent: Mar. 6, 2001

(54) LOCK SYSTEM ENABLING USER TO LOCK DOOR AND EXTEND LOCK BOLT IN A SINGLE ACTION AND PUSH-PULL LOCK WITH CUSHIONING ARRANGEMENT FOR PROTECTING BOLT DRIVE COMPONENTS

(75) Inventors: Ned Urschel, Lexington, KY (US); Cedric Cuenot, Le Locle (CH); Christophe Dexet, Thiebouhans (FR); Jacques Wicht, Bienne (CH)

(73) Assignee: Sargent & Greenleaf, Inc., Nicholasville, KY (US)

( * ) Notice: Subject to any disclaimer, the term of this patent is extended or adjusted under 35 U.S.C. 154(b) by 0 days.

(21) Appl. No.: 09/122,785

(22) Filed: Jul. 27, 1998

Related U.S. Application Data

(63) Continuation of application No. 09/066,601, filed on Apr. 27, 1998, now Pat. No. 6,094,952

(60) Provisional application No. 60/070,366, filed on Jan. 2, 1998.

(51) Int. Cl.[7] ..... E05B 47/02

(52) U.S. Cl. ..... 70/416; 70/333 R; 70/278.1; 70/303 A

(58) Field of Search ..... 70/413, 416, 278, 70/303 A, 333 A, 333 R

(56) References Cited

U.S. PATENT DOCUMENTS

| | | | |
|---|---|---|---|
| 4,926,664 | 5/1990 | Gartner et al. | 70/278 |
| 5,020,345 | 6/1991 | Gartner et al. | 70/277 |
| 5,033,282 | 7/1991 | Gartner et al. | 70/278 |
| 5,473,922 | 12/1995 | Bair et al. | 70/416 |
| 5,640,862 | 6/1997 | Remenicky | 70/278 |
| 5,709,114 | 1/1998 | Dawson et al. | 70/278 |
| 5,845,523 | 12/1998 | Butterweck et al. | 70/278 |

*Primary Examiner*—Suzanne Dino Barrett
(74) *Attorney, Agent, or Firm*—Jacobson, Price, Holman & Stern, PLLC

(57) ABSTRACT

A dead bolt lock automatically blocks the extended bolt to prevent externally-applied force from thrusting the bolt back into the lock case, and in the event of physical attack the lock responds by prolonging or perpetuating the dead bolt blocking condition. A push-pull lock has a bolt whose motion in both directions is stopped in response to detection of a rise in motor current above a certain level: a cushioning arrangement allows the current-limiting feature to be implemented without risk of damage to the motor, gear teeth or other drive components. A re-locker arrangement includes an angled flange that is part of a motor-supporting bracket; when forcibly pressed, the flange breaks plastic pins to release a spring-biased re-locker wire to block the bolt from being withdrawn, and when the wire is in the dead bolting position an extension of the re-locker wire engages a ridge in the lock's case to prevent the re-locker from being manipulated back to its original position. Either lock can control the position of a bolt works blocking element that selectively engages a lever-driven mechanism that blocks and unblocks the door from being opened. A sensor switch, especially for use on the push-pull lock, tells the lock when the mechanism is in a secured position, so that the lock is automatically re-locked and the user does not have to manually extend the bolt. Finally, the system has a keypad tampering detection and response system, remote enable/disable unit, duress detection and response unit, low-battery sensing arrangement, bolt extension indication feature, adjustable bolt throw feature, and audit trail feature.

7 Claims, 15 Drawing Sheets

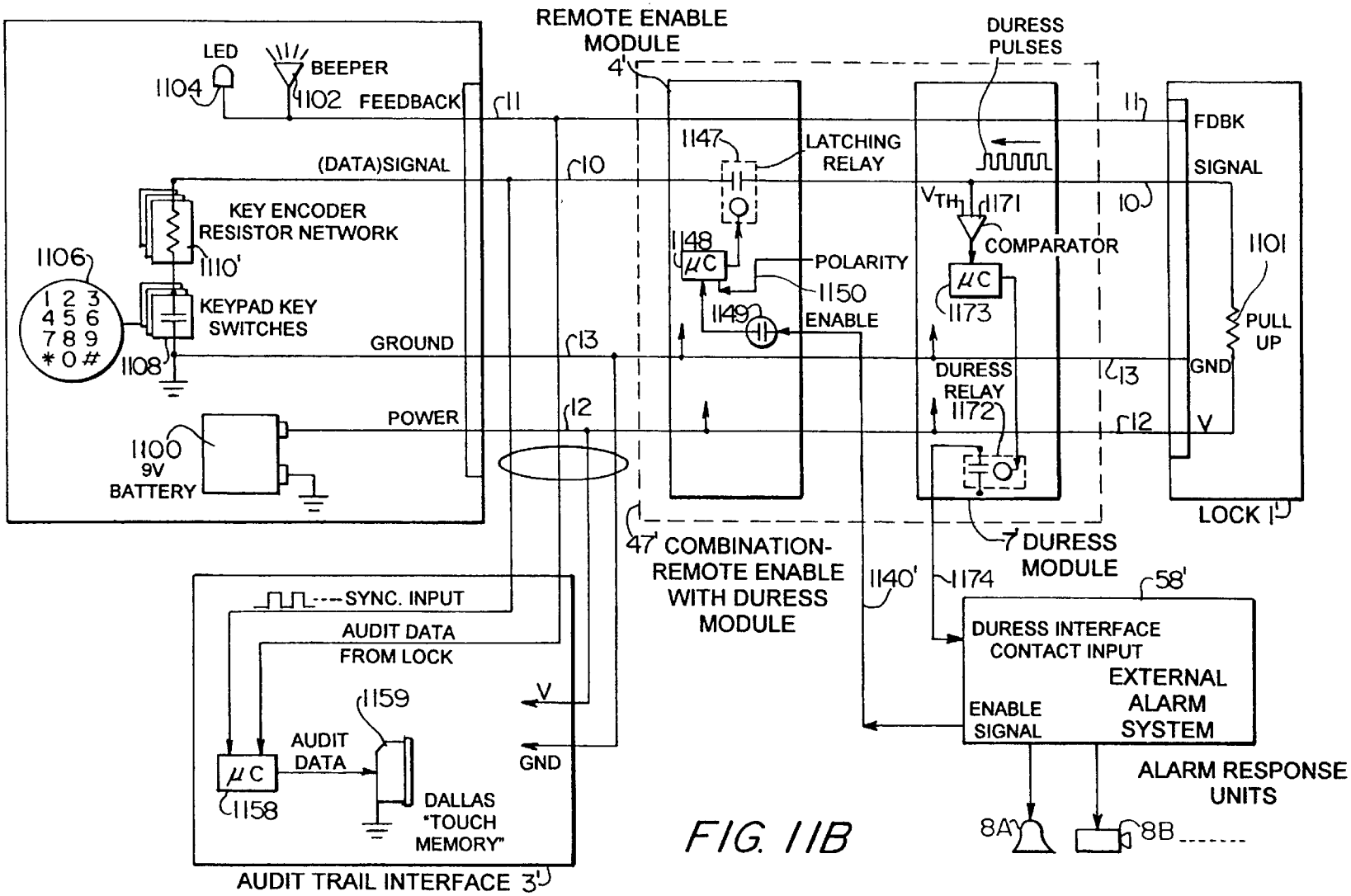
FDBK
SIGNAL
1101
PULL UP
GND
V
LOCK 1
11
10
13
12
DURESS PULSES
COMPARATOR
1171
$V_{TH}$
μC
1173
DURESS RELAY 1172
DURESS MODULE
7
1174
58'
DURESS INTERFACE CONTACT INPUT
EXTERNAL ALARM SYSTEM
ENABLE SIGNAL
ALARM RESPONSE UNITS
8A
8B
1140'
LATCHING RELAY
POLARITY
1150
ENABLE
1147
1148
μC
1149
REMOTE ENABLE MODULE
4'
47'
COMBINATION-REMOTE ENABLE WITH DURESS MODULE
FIG. 11B
10
13
12
11
V
GND
FEEDBACK
(DATA)SIGNAL
GROUND
POWER
BEEPER
1102
LED
1104
KEY ENCODER RESISTOR NETWORK
1110'
KEYPAD KEY SWITCHES
1108
1106
1 2 3
4 5 6
7 8 9
* 0 #
1100
9V BATTERY
SYNC. INPUT
AUDIT DATA FROM LOCK
1159
DALLAS "TOUCH MEMORY"
AUDIT DATA
μC
1158
AUDIT TRAIL INTERFACE 3'

LOCK SYSTEM ENABLING USER TO LOCK DOOR AND EXTEND LOCK BOLT IN A SINGLE ACTION AND PUSH-PULL LOCK WITH CUSHIONING ARRANGEMENT FOR PROTECTING BOLT DRIVE COMPONENTS

This is a continuation of U.S. application Ser. No. 09/066,601, filed Apr. 27, 1998 and now U.S. Pat. No. 6,094,952.

Priority is claimed under 35 U.S.C. § 119(e)(1) to provisional application 60/070,366, filed Jan. 2, 1998, of which the present application is a continuation-in-part.

BACKGROUND OF THE INVENTION

1. Field of the Invention

The present invention relates to locks, especially electronic locks having motor-driven bolts. More specifically, the invention relates to locks in which it is desired that the bolt, once extended, cannot be forcibly pushed in but can only be withdrawn into the lock with entry of a proper combination or other authorization. The invention also relates to locks in which it is desired to respond to certain types of physical attack by rendering the bolt incapable of being withdrawn. The invention further relates to locks in which various security enhancements are provided.

2. Related Art

Numerous conventional lock designs have been provided in which a bolt may be extended or withdrawn in response to entry of a combination of other authorization. However, some of the designs have not provided a "dead bolt" feature, which involves physical blocking of the extended bolt so that, after the bolt has been extended into its "locked" position, the lock resists externally applied pressure that attempts to force the bolt back into the lock case.

Also, it is envisioned that locks are physically attacked in may ways, including drilling into the lock case. It is desired that a lock not merely physically resist such attacks, but also respond appropriately to such attacks by ensuring that the bolt cannot be withdrawn during or after the attack. In other words, it is desirable to prolong or perpetuate the "dead bolt" state so that in the event of physical attack, it becomes even harder for a perpetrator to gain entry into the protected area. Many known locks do not prolong or perpetuate a "dead bolt" state after the lock has been physically attacked, and thus do not provide adequate additional protection in that scenario.

Further, many known lock systems that involve "bolt works" require two separate actions to extend the blocking member from the door into the doorjamb, and to re-extend the bolt from the lock case. This is not merely inconvenient, but presents an additional security risk should the individual neglect to perform the second action. Additionally, it is desirable in such systems to provide a "bolt throw" (extent of movement of the bolt) that is adjustable so as to easily adapt a single lock to a variety of installations and different types of bolt works.

Moreover, many known lock systems possess minimal locking functions, and do not provide additional security enhancement features. Applicants have recognized that such security enhancements include detection and response to tampering with the keypad unit, remote enablement and disablement of the lock, detection and response to a user's attempting to open the lock while under duress, and the ability to store and later transmit a history of occurrences in the lock system.

It is to meet these and other goals that the present invention is directed. No known conventional lock is believed to have the features and advantages of the inventive locks that are described in the following specification.

SUMMARY OF THE INVENTION

The invention provides a dead bolt lock that automatically blocks the extended bolt so as to prevent externally-applied force from thrusting the bolt back into the lock case. Advantageously, the dead bolt feature does not require additional consumption of energy, but is invoked by the mere extension of the bolt into its "locked" position.

The invention further provides that, in the event of certain types of physical attack, the lock responds by prolonging or perpetuating the dead bolt blocking condition. This response is ensured by the physical relation of the lock elements, and requires no additional power or control operation on the part of the lock.

Advantageously, both the automatic dead bolting feature, and the attack response feature that prolongs or perpetuates the dead bolting state, are provided using essentially the same mechanical elements, thus reducing the number of parts required for construction of the lock and reducing its fabrication cost.

The invention also provides a "push-pull" lock with a bolt whose motion in both directions is stopped in response to detection of a rise in motor current above a certain level. A cushioning arrangement allows the current limiting feature to be implemented without risk of damage to the motor, gear teeth or other drive components.

A re-locker arrangement involves an angled flange that is part of a motor-supporting bracket. When the flange is pressed with a force high enough to allow a drill to begin to remove material from a hard protective plate, the flange breaks plastic pins to release a spring-biased re-locker wire to block the bolt from being withdrawn. Further, when the wire is in the dead bolting position, an extension of the re-locker wire engages a ridge in the lock's case to prevent the re-locker from being manipulated back to its original position.

The invention also provides a lock system in which a lock controls the position of a bolt works blocking element that selectively engages a lever-driven mechanism that blocks and unblocks the door from being opened. A sensor switch, preferably located within the bolt works mechanism, tells the lock when the mechanism has been moved into a secured position, so that the lock automatically re-locks the lock (extends the bolt and moves the bolt works blocking element to engage the lever-driven mechanism). In this manner, the user does not have to carry out a second step of manually extending the bolt.

Finally, the invention provides various security enhancement features, such as a novel keypad tampering detection and response system, a remote enable/disable unit, a duress detection and response unit, a low battery sensing arrangement, a bolt extension indicator, an easily adjustable bolt throw feature, and an audit trail feature.

These and other features and advantages of the invention will be apparent to those skilled in the art upon a reading of the accompanying Detailed Description with reference to the accompanying drawing figures.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which:

FIG. 11B schematically illustrates an alternative embodiment for implementing the functions of FIG. 11A. Collectively, FIGS. 11A and 11B may be referred to herein as "FIG. 11".

DETAILED DESCRIPTION OF THE PREFERRED EMBODIMENTS

Figures 1, 2:
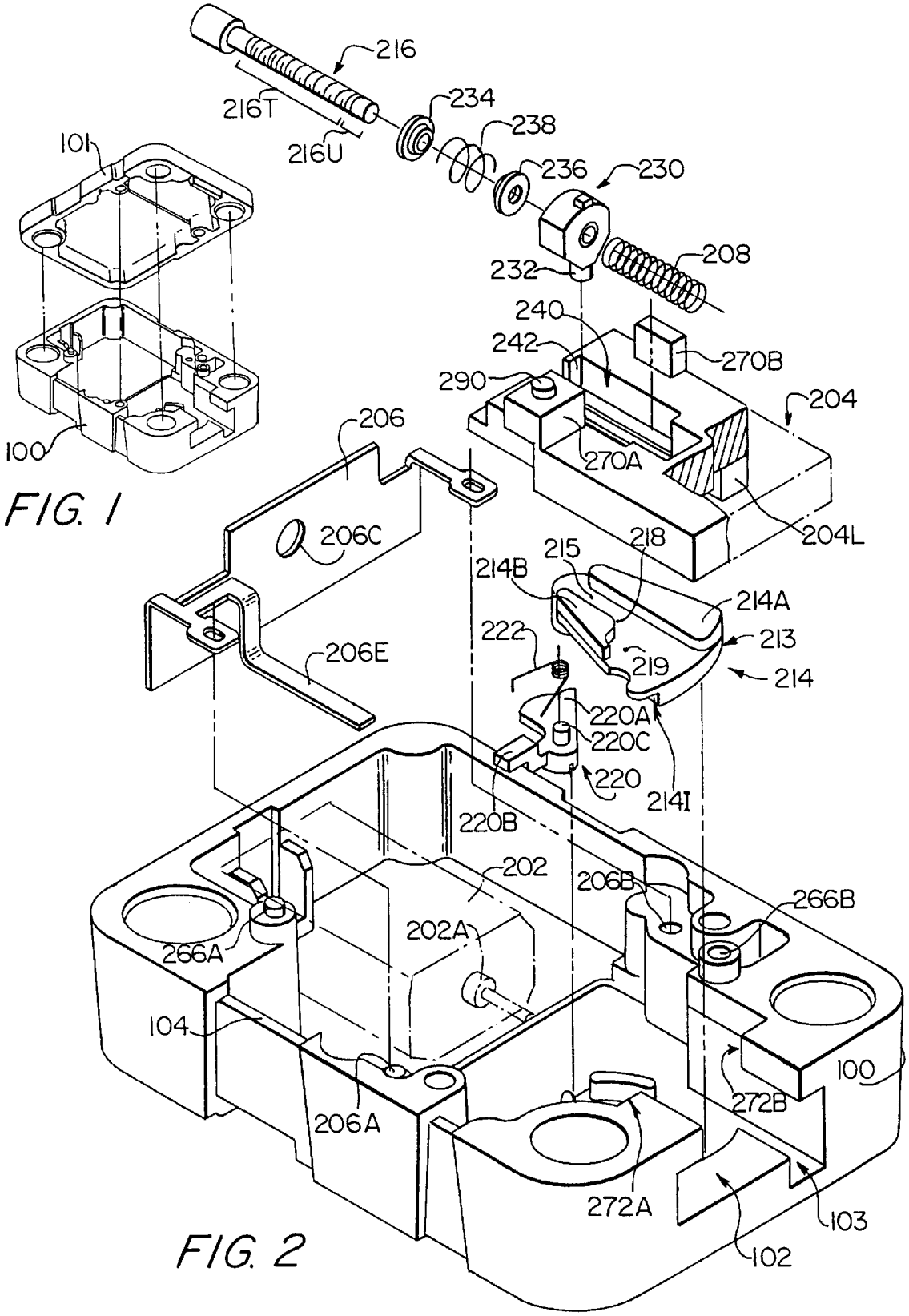
FIG. 1 is an exploded perspective view of a lock case 100 with cover 101, according to a dead bolt lock according to a first preferred embodiment of the present invention.
FIG. 2 is an exploded perspective view of certain important mechanical components according to an embodiment of the dead bolt lock according to the present invention.

In describing preferred embodiments of the present invention illustrated in the drawings, specific terminology is employed for the sake of clarity. However, the invention is not intended to be limited to the specific terminology so selected, and it is to be understood that each specific element includes all technical equivalents that operate in a similar manner to accomplish a similar purpose. For example, the terms front, back, upper, lower, left, right, clockwise, counter-clockwise, and the like, are intended as relative terms for facilitating an understanding of the illustrated embodiments, and not as absolute limiting terms for the invention being claimed.

Embodiments

First, a first embodiment of a lock, specifically a dead bolt lock according to the invention, is described. Thereafter, a second embodiment, directed to a push-pull lock, is described. Finally, various lock system features, which may include locks according to the first or second embodiment, are described.

Dead Bolt Lock: Mechanical Structure and Basic Operations

Figure 3A:
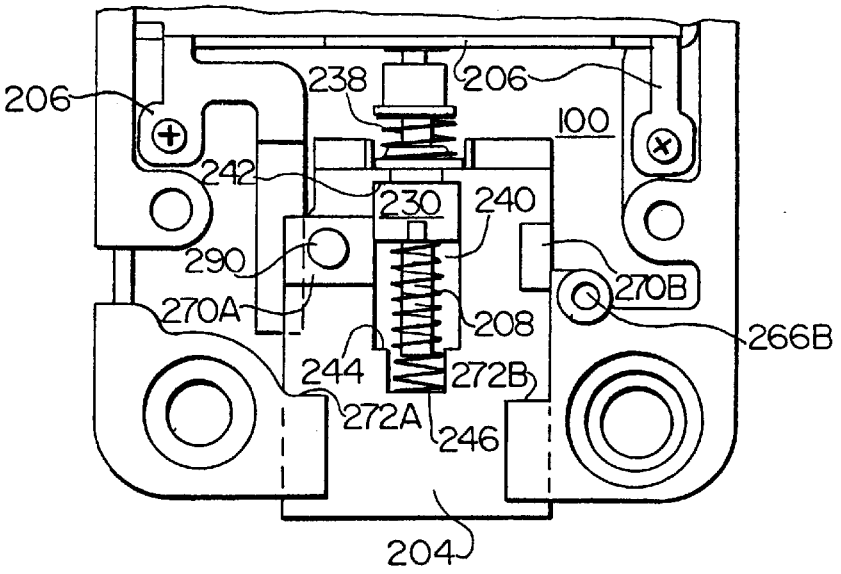
FIG. 3A is a plan view of the lock of FIG. 2 with the bolt in its withdrawn (unlocked) position.
Figure 3B:
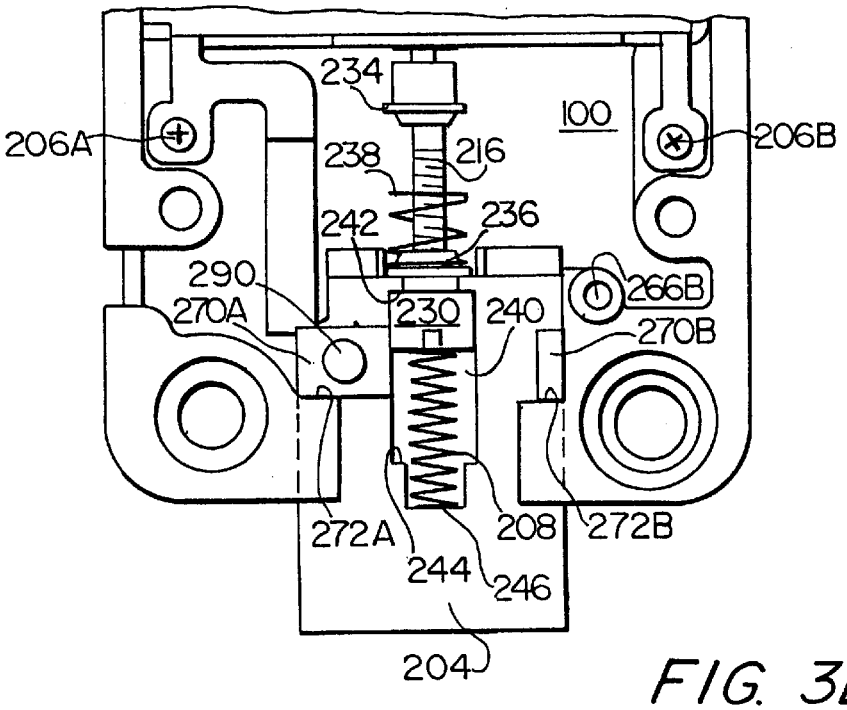
FIG. 3B is a plan view of the lock of FIG. 2 with the bolt in its extended (locked) position
Figure 4:
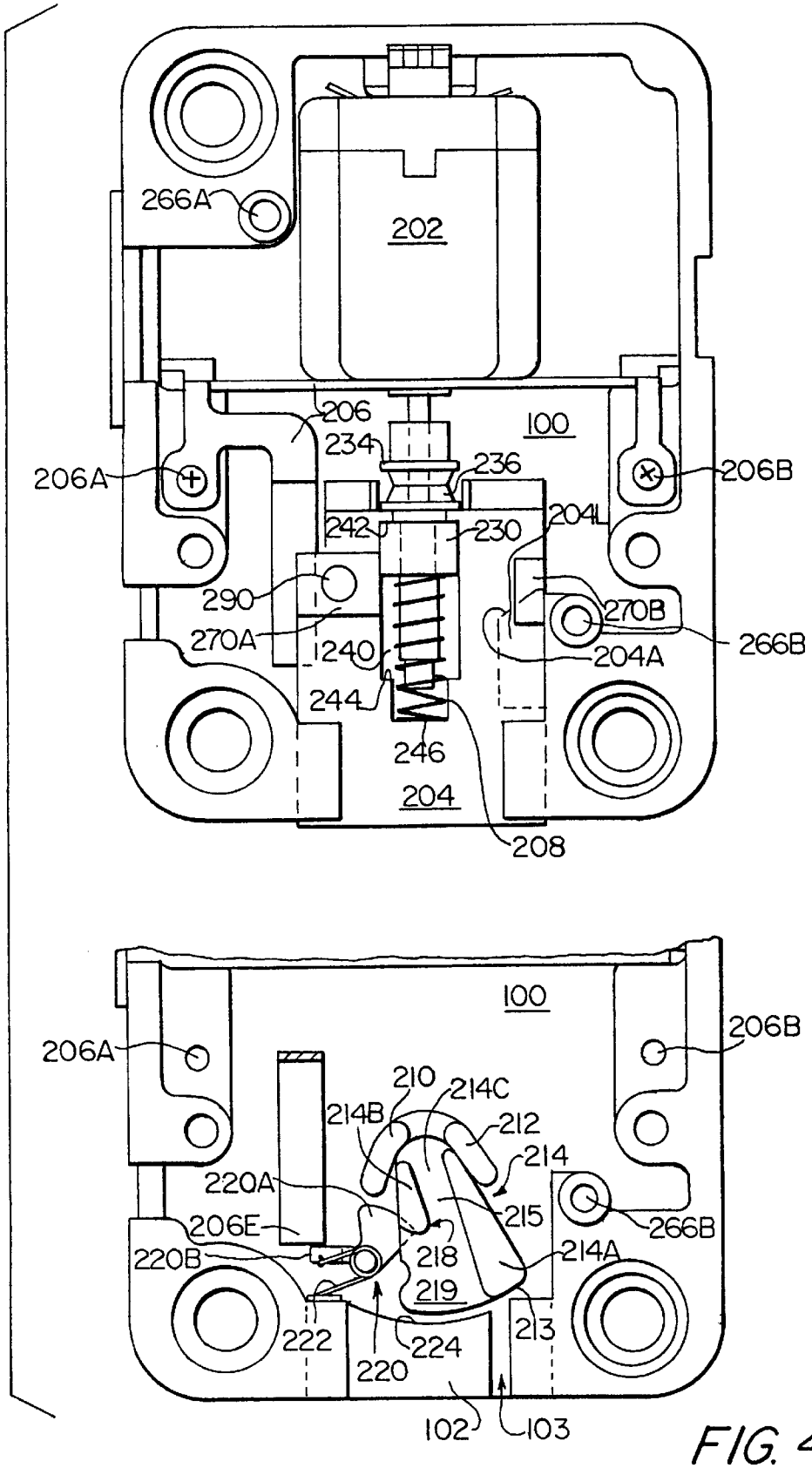
FIG. 4 is a partially-exploded (two-layer) plan view. The top layer shows a motor 202, motor bracket 206, screw 216, nut 230, and bolt 204. The partial bottom layer shows a rocker 214, spring-biased latch 220, and motor bracket extension 206E, that are disposed under the bolt. The two layers of the drawing repeat certain elements, such as the case and motor bracket extension, to facilitate an understanding of how the two layers fit together.
Figure 5A:
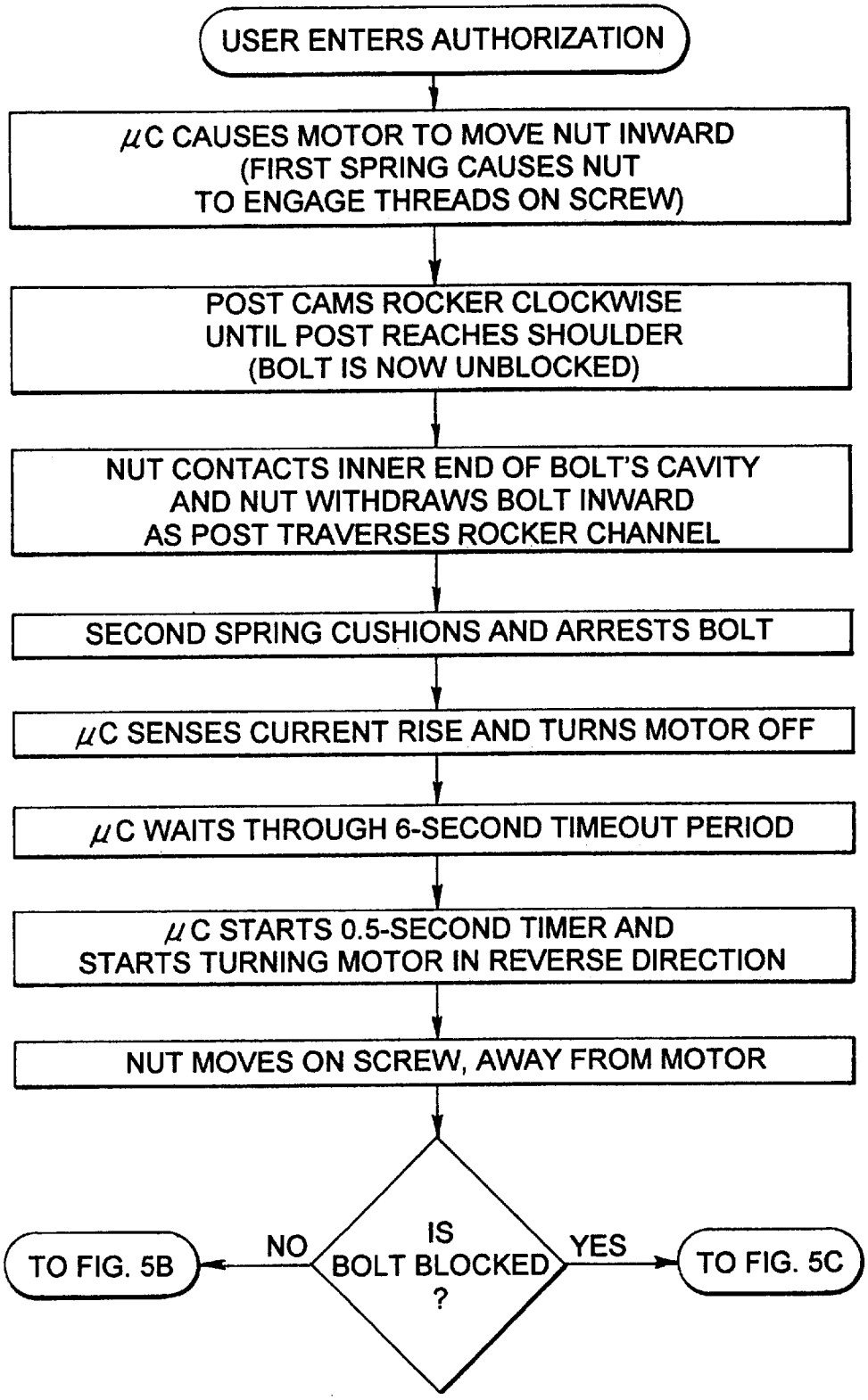
FIGS. 5A, 5B, and 5C (which may collectively be referred to herein as FIG. 5) are a flow chart that illustrates operation of the embodiment of the dead bolt lock of FIGS. 1–4
Figure 5B:
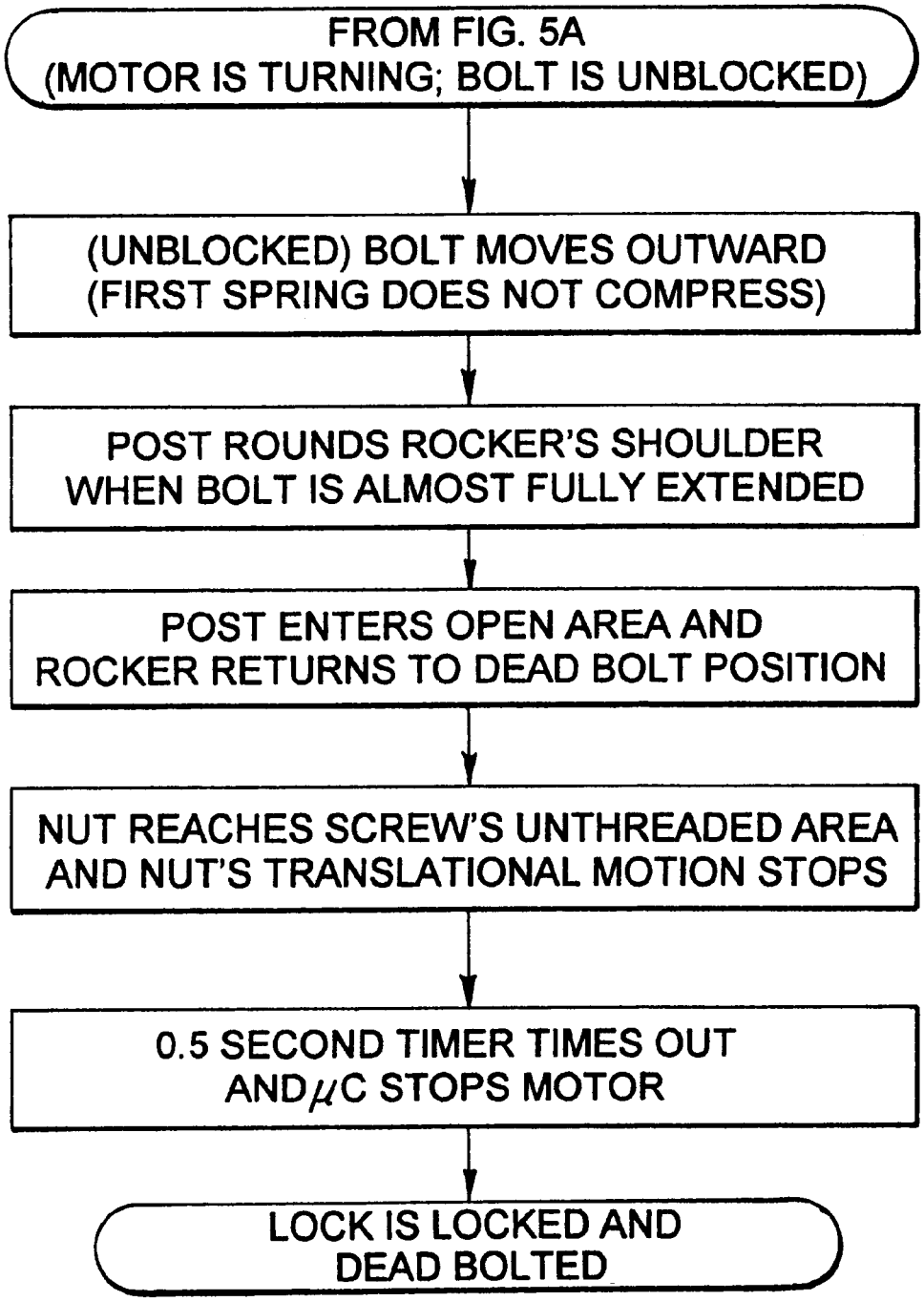
Figure 5C:
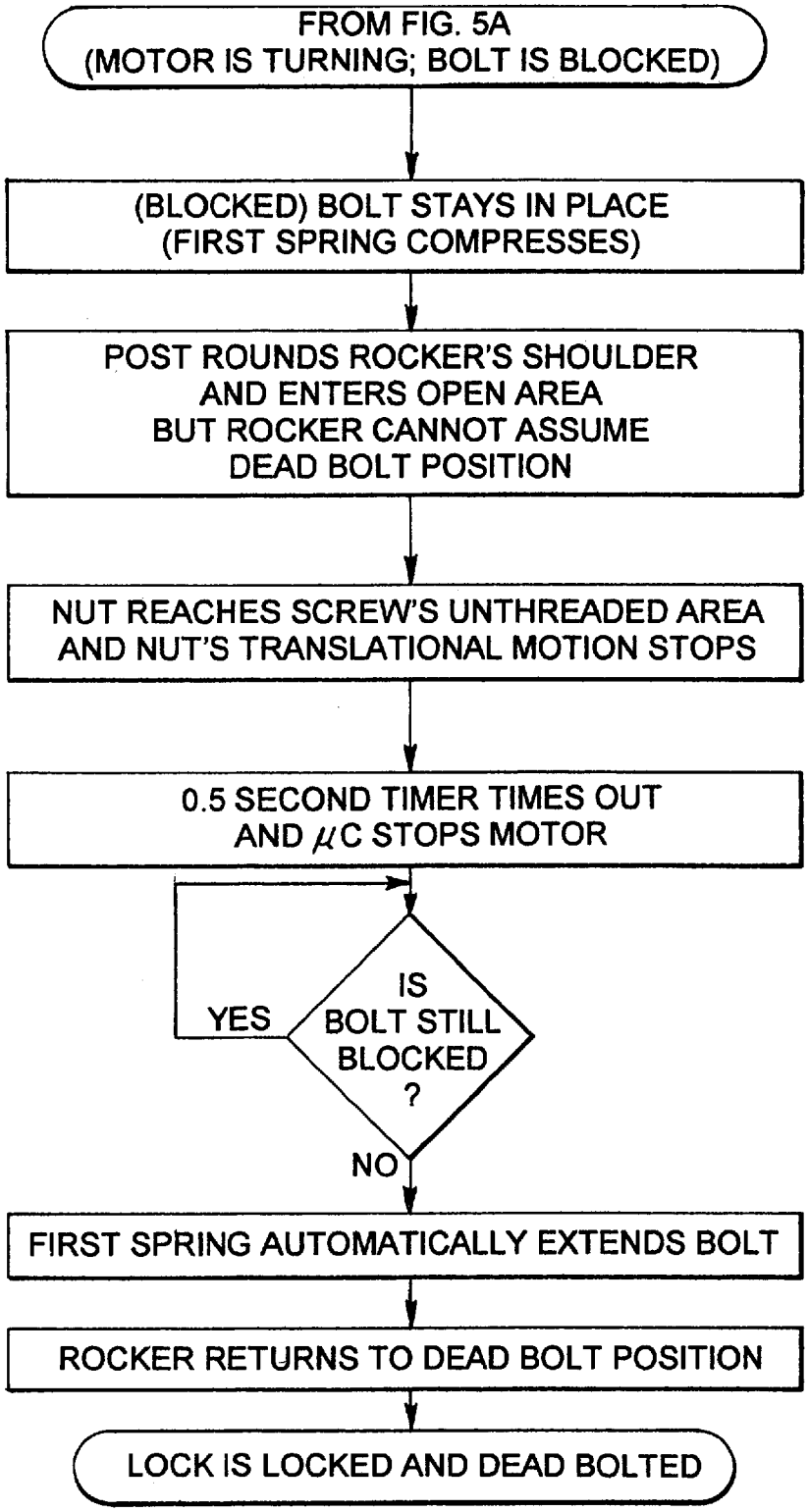

FIGS. 1–4 illustrate the construction of a preferred, non-limiting embodiment of a dead bolt lock according to the present invention, with the flow chart of FIGS. 5A–5C showing its operation.

A motor 202, which may be powered by batteries or other suitable means, is the motive force behind operation of the lock, and controls whether bolt 204 is withdrawn into or extended from the lock's case 100. Preferably, the batteries are located remote from the lock itself, in a housing to which the lock is connected by a cable (not specifically shown), that may be, for example, a ribbon cable. In a particular embodiment, the batteries are located in a keypad housing, and provide power to the keypad and lock, as well as other modular elements that may be present in the system. The ribbon cable leads from a keypad, card reader, or other access control device through a padded opening 104 in the side of the lock's case 100. After passing through the padded opening, the cable connects with a circuit board (not shown, but described below) that is connected to the motor 202 by a suitable internal cable.

The motor 202 is fixed within case 100 by a motor bracket 206 that secures the motor by capturing motor hub 202A in motor bracket hole 206C, without fasteners. The motor bracket is attached to the case at points 206A, 206B. The axle of the motor passes through an opening 206C in the motor bracket.

A circuit board (not shown) is attached to the case at points 266A, 266B. The circuit board includes a microprocessor or microcontroller (hereinafter abbreviated $\mu$C), along with conventional support and protection circuitry (level shifters, buffers, by-pass capacitors, spike suppressors, and so forth). The board also includes suitable memory such as read only memory (ROM), random access memory (RAM) and electrically erasable programmable read-only memory (EEPROM), all of which may be resident in the $\mu$C itself (see FIG. 6). Except where specifically described in this specification, the particular choice, design, programming and operation of the circuit board lie within the ability of those skilled in the art, and no additional details thereof need be provided for one skilled in the art to readily appreciate and implement the invention.

Referring again to FIGS. 2, 3A, and 3B, a partially-threaded screw 216, having a shaft with a threaded inner portion 216T and an unthreaded outer portion 216U, is driven by motor 202. The motor moves a nut 230 axially along screw 216, either toward the motor or away from the motor, depending on its direction of rotation.

As the screw 216 is rotated, the nut 230 is displaced axially on the screw, but remains within a generally rectangular cavity 240 in the bolt. The cavity has an inner surface 242 that is disposed closer to the motor, and an outer surface 244 that is disposed further from the motor and closer to the outside of the lock. A first coil spring 208, disposed co-axially about the screw, presses axially between the nut 230 and an extreme outer surface 246 of the bolt's cavity 240, to press the bolt 204 away from the nut/screw assembly. This pressure biases the bolt in a direction out of the lock case 100.

The position of nut 230, being controlled by the screw's rotation, sometimes acting in conjunction with first coil spring 208, determines the position of the lock's bolt. As the motor rotates the screw in a direction to force the nut away from the motor, the nut presses against the first coil spring which in turn urges the bolt to extend from the lock case. Conversely, as the motor rotates the screw in a direction to force the nut toward the motor, the bolt is withdrawn into the lock.

The surface of bolt 204 that is visible in FIGS. 3A, 3B and 4 is provided with first and second stops 270A, 270B. As the bolt is extended, it moves until stops 270A, 270B contact respective blocks 272A, 272B that are integral parts of lock case 100. Blocks 272A, 272B thus limit the extent to which the bolt 204 can be extended from the lock case. In the lock case shown in FIGS. 1, 2, and 4A, the main body of the bolt 204 extends above a platform 102, whereas a lower protrusion 204L that protrudes downward from the bolt (FIGS. 2, 4) passes through a notch 103 in the case (FIG. 2).

Lock case 100 is provided with two protrusions 210, 212 that retain and limit a rocker 214 (FIGS. 2, 4) as the rocker rotates about a center of rotation 214C. A latch 220 (FIGS. 2, 4) is provided with first and second projections 220A, 220B. In normal operation, a torsion spring 222 urges latch 220 in a clockwise direction (as viewed in FIGS. 2 and 4) about a center of rotation 220C. When the latch is thus urged clockwise, first projection 220A presses against an indented surface 2141 (FIG. 2) formed on the "bottom" face of the rocker (understood to mean the face that is not visible in FIG. 4). Pressure from the first latch projection 220A urges the rocker 214 counter-clockwise (as viewed in FIG. 4). In normal operation, motor bracket extension 206E blocks the rotation of second projection 220B on the latch.

Nut 230 is provided with a post 232 (FIG. 2) that extends radially away from the screw, through the bottom of bolt cavity 240, and toward the rocker 214. The "top" surface of rocker 214 (in this discussion, denoting the surface of the rocker that is visible in FIG. 4) is provided with first and second post guides 214A, 214B, that form a channel 215 for the nut's post.

Operation of the Lead Bolt Lock

Preferred methods of lock operation, in extending and withdrawing the bolt, are now described. Special reference is made to the functional flow chart of FIGS. 5A through 5C.

Locking the Dead Bolt Lock (Extending the Bolt)

Briefly, as the motor rotates screw 216 to cause the bolt to be extended from the lock, post 232 (FIG. 2) moves within the rocker's channel 215 (FIG. 4) during a first part of the nut's axial movement along the screw. However, as the post moves sufficiently far from motor 202, the bolt nears its fully-extended position, and the post 232 rounds shoulder 218 and escapes the channel 215 to an open area 219 on the rocker.

In normal operation, when the post is within the rocker's channel 215, the post 232 governs the rotational position of the rocker 214 despite the spring-biased latch 220. However, when the post escapes to open area 219 when the bolt is fully or almost fully extended, the rocker 214 is urged counter-clockwise to the maximum extent by spring-biased latch 220. When the rocker 214 is at its fully counter-clockwise position, its blocking surface 213 is disposed immediately opposite an angled surface 204A (FIG. 4) extending from the protrusion 204L (FIG. 2) on the "bottom" side of bolt 204 that is not visible in FIG. 4. When in this position, blocking surface 213 blocks bolt protrusion 204L and thus prevents any externally applied pressure from forcing the bolt back into the lock case.

In this manner, the arrangement of spring-biased latch 220, and rocker 214 with a limited-length channel 215 and a blocking surface 213, serves as a dead bolt arrangement. This arrangement requires no additional external energy to maintain its dead bolt function, as the force of torsion spring 222 ultimately maintains the blocking surface 213 in its blocking position.

To extend the bolt out of the lock case, the motor turns a predetermined time period (for example, 0.5 seconds) that is sufficient to move the nut off of the threaded portion 216T of the screw 216 onto its unthreaded outer portion 216U (FIG. 2). After the nut 230 has reached the unthreaded portion 216U of the screw, the screw continues to turn for a short time (the remainder of the 0.5-second time period), but the nut 230 remains stationary because it is no longer on the threaded portion. If the bolt 204 is blocked from extending (for example, by a doorjamb or opened bolt works), the first coil spring 208 resists motion of the nut 230 to some extent, but the motor does not experience the sudden resistance that it would if the nut were to suddenly encounter an immovable barrier.

The nut moves out to the unthreaded portion of the screw, increasing the load on spring 208 until the nut stops moving. The rocker is prevented from moving into its blocking position until the bolt works (or other blocking structure such as a door jamb) is closed. Loading of spring 208 causes the bolt to fully extend, and spring 222 causes the rocker to move to its blocking position.

It is envisioned that the locked, dead bolted position is the position that the lock assumes almost all the time in normal operation. A first exception is the few seconds after s an authorized user has entered an authorization (combination of numbers, key card, or the like), in which case the rocker 214 is temporarily moved out of the bolt's way so that the bolt can be withdrawn. Also, as described below, in the event of certain types of physical attack on the lock (not considered to be normal operation), the latch 220 is moved into a position that permanently blocks the rocker in its dead bolting position. These exceptions are described below.

Unlocking the Dead Bolt Lock (Withdrawing the Bolt)

See FIG. 5A. In normal operation, when a user enters a correct authorization, motor 202 is activated to turn screw 216 in a direction that causes the nut 230 and its attached post 232 to move toward the motor.

Before the motor is activated, the post is located in open area 219 of the rocker. When the motor is first activated, the post immediately cams the second post guide 214B on rocker 214. When the post cams post guide 214B, it urges the rocker 214 to rotate in a clockwise direction (as viewed in FIG. 4), against the force of torsion spring 222 acting on latch 220.

When the motor first begins to withdraw the bolt, the nut 230 is on the unthreaded portion 216U of the screw 216. In a preferred embodiment, during this initial motion of the nut and post, the nut first traverses a small gap (not shown) between the nut's resting position on the screw's unthreaded portion and the innermost edge 242 of bolt cavity 240. The nut 230 is always urged against the threads by the first coil spring 208, but the nut 230 does not engage the screw's threads until after the motor begins to turn the screw. The bolt 204 does not actually begin to move inward until after the nut has engaged the screw's threads and has traversed and closed the small gap so as to contact the innermost edge 242 of the bolt's cavity.

In this manner, the post 232 cams the rocker 214 out of the bolt's way just before the nut 230 begins to move the bolt.

After the rocker has rotated a sufficient amount the post rounds the rocker's shoulder 218 (FIG. 4) to mark the maximum clockwise rotation of the rocker. At this time, the rocker's blocking surface 213 has been rotated out of the way of angled surface 204A on the bottom of the bolt. With the blocking surface 213 out of the way, the dead bolt function of the lock has been removed, so that the bolt can be withdrawn into the lock case.

After the nut's post 232 has rounded the rocker's shoulder 218, the post enters the rocker's channel 215. Continued rotation of the motor and screw moves the post up the channel as the bolt is withdrawn further into the lock case.

First and second bushings 234, 236 are provided co-axially about screw 216. First bushing 234 and second bushing 236 are free to rotate on the screw, with second bushing 236 being located closer to the inner end of bolt 204. The bushings have respective annular flanges that retain a second coil spring 238 (shown in FIGS. 2, 3A, 3B but omitted from FIG. 4). Second coil spring 238 cushions the bolt's stop, to prevent the motor from being overloaded. The bushings prevent wear of the spring, screw and bolt. As the second coil spring 238 begins to compress, it does not rotate with the screw, and the bushings prevent wear as the screw continues to rotate.

According to a preferred embodiment of the invention, the motor is turned off when a microprocessor or microcontroller ($\mu$C) senses motor current to exceed a load limit.

Figures 6, 7:
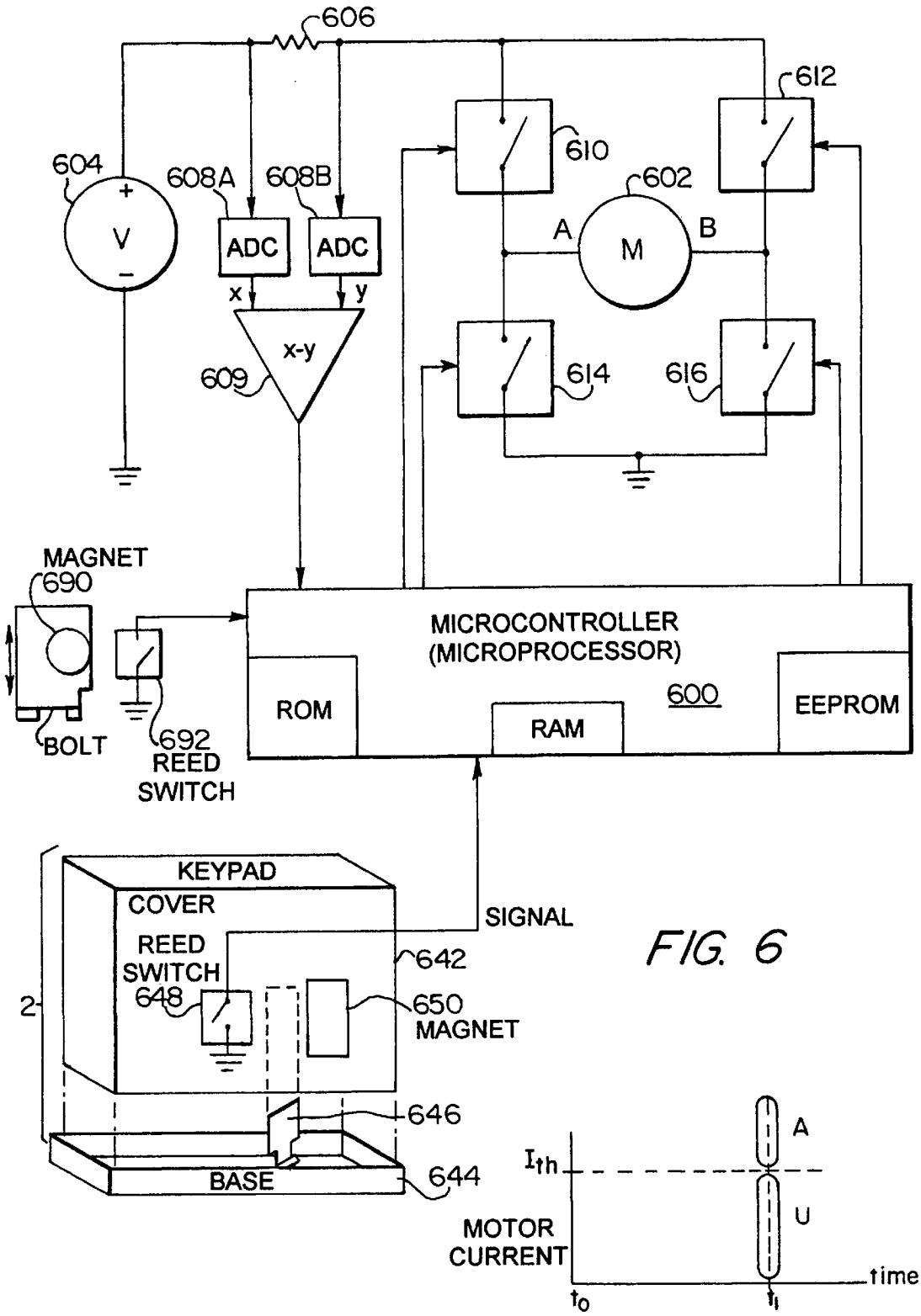
FIG. 6 is a schematic diagram illustrating exemplary arrangements for motor control, battery level sensing, motor current sensing, keypad tamper sensing, and bolt position sensing according to either the lock of FIGS. 1–5 or of FIGS. 8–10C.
FIG 7 graphically illustrates the battery level sensing arrangement that involves determining motor current at a chosen time after starting the motor.

As shown schematically in FIG. 6, a microprocessor ($\mu$C) 600 (such as an SGS Thompson ST62T60B) is shown in conjunction with a DC motor 602 and four electronic switches 610, 612, 614, 616. The microprocessor 600 controls the four switches to selectively apply to the motor, either (1) no voltage, when the motor is to be stopped, (2) a forward voltage, to rotate the motor in a first direction, or (3) a reverse voltage, to rotate the motor in a second direction. The forward and reverse voltages are derived from a voltage source 604 that may include (for example) two parallel-connected nine-volt alkaline batteries. Current sensing may be performed indirectly, by measuring voltage across a resistor (or resistor bank) 606.

More specifically, when the microprocessor ($\mu$C) turns first and fourth switches 610, 616 to their conducting state, current passes through the motor from terminal A to terminal B, and the motor rotates in a first direction (for example, to extend the bolt). Conversely, when the microprocessor turns second and third switches 612, 614 to their conducting state, current passes through the motor from terminal B to terminal A, and the motor rotates in a second direction (for example, to withdraw the bolt). It is during withdrawal of the bolt that the current sensing feature of the invention is most useful.

When the current is sensed to have exceeded a certain overload threshold, the microprocessor acts to cut power to the motor, thus shutting the motor off and preventing mechanical binding or motor damage when the bolt has reached its fully withdrawn position. The electrical and electronic operation of the microprocessor and motor control are described in greater detail with reference to FIG. 7, in the description of the low battery sensing feature.

After the Dead Bolt Lock Has Been Opened

The next discussion relates to operation of the dead bolt lock immediately after the lock has been opened.

"Timeout" Feature

In operation, when a correct combination or other authorization is entered, the bolt is preferably withdrawn only for a predetermined period of time (such as fifteen seconds on the push-pull lock, or six seconds on the dead bolt lock). After this predetermined period of time expires (a "timeout" period), the motor automatically extends (or attempts to extend) the bolt.

This "timeout" feature ensures that, if a correct combination is entered, the safe door must be opened almost immediately; otherwise, the bolt extends at the end of the timeout period and the combination would have to be entered again. This feature provides extra security in a scenario in which an authorized individual enters a correct combination but is distracted and has to leave the area. Without the timeout feature, a closed door to a safe might falsely indicate that the safe is locked, and unauthorized individuals would have access to the safe if the bolt were not automatically re-extended. However, with the timeout feature, if the safe's door is closed and a combination has not been entered in the past few seconds, the bolt is automatically extended and the foregoing security risk is avoided.

If the Bolt is Blocked

See especially the flow chart in FIG. 5C.

Normally, after the lock is withdrawn, the user opens the door completely, in which case the bolt is readily extended again because there is nothing blocking the bolt's path. However, it is recognized that, after the bolt has been withdrawn, it is possible that the user may move the door only a small distance, great enough that the bolt no longer aligns with a cavity in the safe's door jamb, but not great enough for the bolt to altogether clear the door jamb. In this scenario, the motor attempts to push the bolt outward, but the doorjamb blocks the bolt's motion.

In this scenario, first coil spring 208 ensures that, with the next movement of the door, the bolt will extend. Specifically, if the door is pushed back into its completely closed position, the bolt aligns with its hole in the jamb and the first spring 208 extends the bolt, locking the door. Conversely, if the door is pulled open, the spring extends the bolt as soon as it clears the doorjamb, thus ensuring the door cannot be completely closed and providing a visual indication that the safe is unlocked.

Figure 13B:
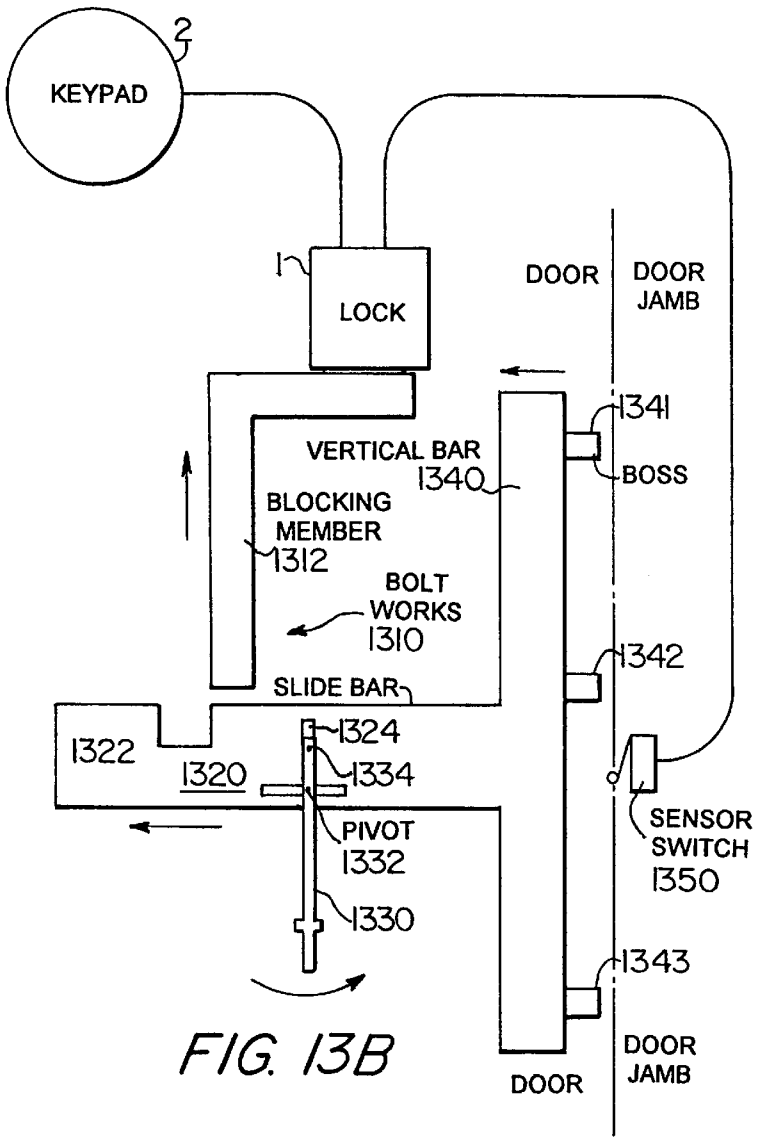
FIGS. 13A and 13B schematically illustrate a locking system including a lock 1, bolt works 1310 and a sensor switch 1350, shown in closed (locked) and open (unlocked) positions, respectively.
Figure 13A:
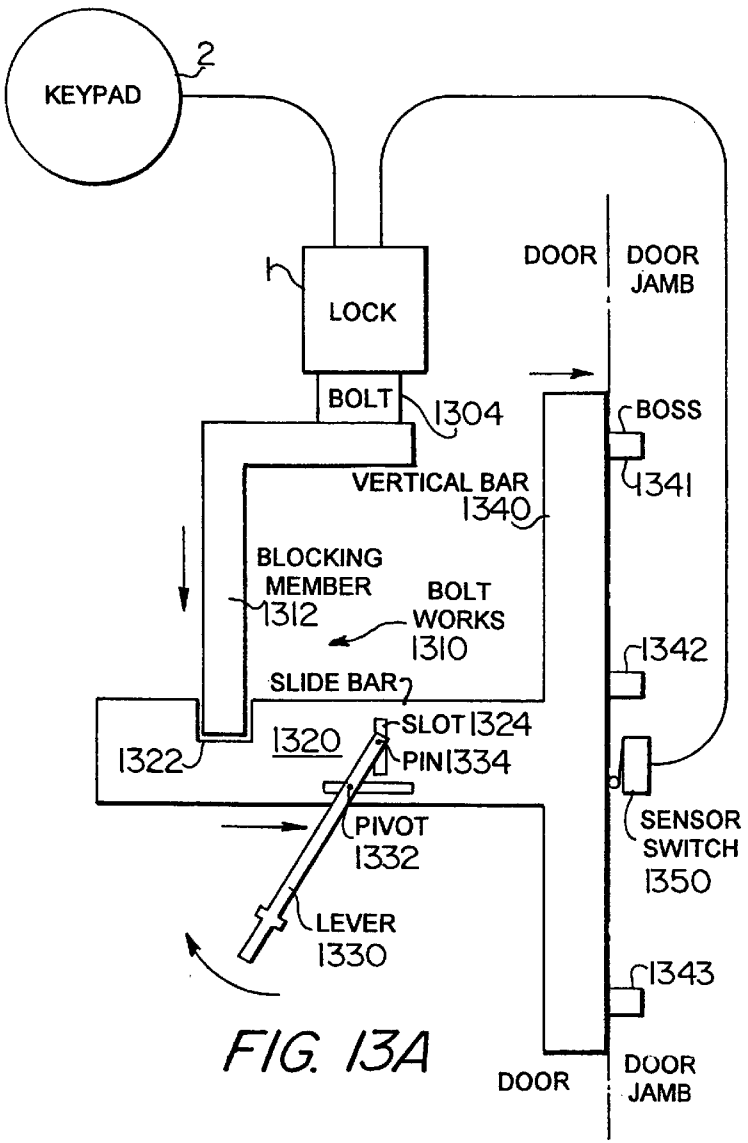

The invention is also applicable to situations in which there are "bolt works" to the safe. The following paragraphs apply to embodiments in which bolt works are attached to the bolt. FIGS. 13A, 13B show an example of bolt works 1310. FIGS. 13A, 13B are discussed in detail below.

However, a simplified embodiment of bolt works (not specifically illustrated) involves bolt works differing from those shown in FIGS. 13A, 13B. In this simplified embodiment, there is no blocking member 1312, and bolt 1304 can extend directly into notch 1322 without any intermediate blocking member. The operation of a lock in which the bolt extends into a door jamb is very similar to operation of the lock in which the bolt extends into a notch in bolt works: if the notch is aligned with the bolt, then the bolt can re-extend completely into the notch, but if the notch is not aligned with the bolt (such as when the bolt works are "open"), then the bolt does not extend immediately but will re-extend when the bolt works are returned to their "closed" position. Concerning the feature of automatic re-extension of the bolt, moving the notch in the bolt works with respect to the bolt is equivalent to opening and closing the door and re-aligning the hole in the doorjamb with the bolt; the internal operating principle of the lock is the same.

Referring now to FIGS. 13A, 13B, if the lock's bolt retracts but the safe bolt works are not positioned to allow the safe door to be opened, the bolt is readily re-extended because there is nothing blocking the bolt's outward path. When the safe door is opened after moving the bolt works, previously blocked by the lock, after the bolt has been withdrawn, the bolt works block the bolt's path so that the bolt cannot extend. In this scenario, the motor attempts to push the bolt outward, but the safe bolt works block the bolt's motion.

In this scenario, first coil spring 208 ensures that, with the next movement of the safe bolt works to secure the safe, the bolt will extend. Specifically, if the bolt works are moved back into the completely closed position, the bolt aligns with its blocking point in the bolt works and the first spring 208 extends the bolt, locking the safe.

The normal operation of the lock having been described, other features of the invention are now described.

First Re-Locking Security Feature (disclosed With Special Reference to the Dead Bolt Lock)

As understood by those skilled in the art, "re-locking" has two definitions. The first denotes an extension of the bolt performed after the bolt has been withdrawn. This re-locking is often performed automatically, without the user's intervention. The above-described automatic extension of the bolt a given time period after the bolt has been withdrawn may be considered a first example of re-locking.

Following is a description of a second type of re-locking, one that is performed when the lock is physically attacked.

It is envisioned that the lock may be physically attacked with a hammer and metal rod or punch through a wire access hole in the safe door, the hole being aligned with the motor 202. In this scenario, it is likely that motor 202 or its motor bracket 206 will be the element that receives the force of the punch attack. Because, according to the invention, motor 202 is connected with its motor bracket 206, the motor bracket will be forced out of position.

If the motor bracket 206 is forced out of position, the bracket extension 206E that normally contacts latch 220 (FIG. 4) is also displaced. When the bracket extension 206E is displaced, it no longer blocks the latch's second projection 220B. Without being thus restrained, rotational force from torsion spring 222 causes the latch to rotate clockwise further than during normal operation.

In a particular embodiment, the latch rotates at least another ninety degrees, so that the first latch projection 220A contacts a rounded portion 224 (FIG. 4) on the lock's case. When the latch is in this extreme clockwise position, any force applied against it by the rocker 214 will actually tend to make the latch 220 rotate further clockwise rather than counter-clockwise as in normal operation. Thus, the extreme clockwise position of the latch 220 not only ensures that the rocker 214 is rotated to its dead bolt position, but also ensures that the bolt cannot be withdrawn unless the lock case is physically opened and the latch physically removed.

Significantly, the same mechanical components that provide the lock's dead bolt functionality also provide its re-locking functionality. This integration of the re-locking feature with the dead bolt biasing feature reduces the number of parts in the lock, thus reducing the cost and complexity of manufacturing the lock.

Low Battery Sensing

Next, a preferred low battery sensing arrangement is described with reference to FIGS. 6 and 7.

As is readily appreciated by those skilled in the art, progressively deteriorating battery performance and their limited useful life can threaten proper functioning of electronic or electrically-powered locks that rely on such batteries. For example, in the locks described in this specification, if the bolt is withdrawn and the battery does not have enough energy to re-extend the bolt, then the bolt will remain in its withdrawn position. This is a serious problem in a scenario in which an individual enters a correct combination but immediately leaves the area, perhaps due to some distraction, but leaves the door to the safe closed. If the bolt remains withdrawn, the safe door falsely appears to be locked when in fact it is vulnerable to access by unauthorized individuals.

Especially for such scenarios, but also to routinely warn owners when batteries should be replaced, the present invention provides an inventive battery sensing arrangement that accurately senses a useful and meaningful assessment of a battery's performance ability. Conventional sensing arrangements sense battery voltage, and cause the lock to respond accordingly, taking defensive action if the measured voltage is below a threshold that is determined in accordance with the particular battery type being tested. In contrast, according to a preferred embodiment of the invention, it is electrical current, rather than voltage, that is sensed. This inventive approach is particularly appropriate to motor-driven locks because motors are essentially current-driven elements.

Moreover, the electrical measurements are made at particularly meaningful points in time, rather than at random points in time as is characteristic of known sensing arrangements. Thus, the inventive arrangement considers not merely an electrical measure, but also involves a temporal measure.

In accordance with an exemplary embodiment, a processor 600 (such as an SGS Thompson ST62T60B) senses the magnitude of motor current within a given time window after the motor is activated. When activated, the motor demands that batteries increase their current output. According to a preferred embodiment, if the current provided to the motor does not rise to a certain level within a predetermined time after activation, a decision is made that the battery has inadequate power to initiate an opening sequence, and suitable defensive action is taken.

For example, if it is determined that the batteries do not have enough power to successfully withdraw a bolt, and wait a given period of time, and thereafter extend the bolt, then it is decided not to withdraw the bolt in the first place, but merely sound an audible and/or visual alarm so that the owners know that the batteries should be replaced.

More specifically, reference is made to FIG. 6 for a schematic illustration of the battery sensing arrangement. After initiating a bolt retraction operation to the motor, the microprocessor or microcontroller ($\mu$C) monitors, as a function of time, the current passing through a resistance (resistor or resistor array) 606. To allow this monitoring, voltage signals received from opposite sides of the resistor are provided to the microprocessor 600 through suitable analog to digital converters (ADCs) 608A, 608B and subtractor 609 that are illustrated schematically in FIG. 6. It is understood that, in a practical embodiment, a microprocessor may be chosen that incorporate the ADCs, and that the subtraction of voltage signal values may be performed in software. In either embodiment, the microprocessor divides the measured voltage difference by the known resistance value of the resistance 606 so as to arrive at a value that represents the instantaneous current passing through the motor as a function of time.

In operation, a timer internal to the microprocessor begins at time $t_0$ (see the timing diagram in FIG. 7), when the lock receives a correct authorization code. At $t_0$, the sensed current passing through the motor is zero, so that a graph of the current is at the graph's origin in FIG. 7. At this time, voltage is applied to the motor, and current begins to rise to overcome the frictional forces resisting turning of the motor. When a time $t_l$ has elapsed, the microprocessor compares the measured current value with a threshold current $I_{TH}$. If the measured current exceeds the threshold current, it is deemed acceptable as indicated by region "A", and operation proceeds normally. However, if the measured current falls short of the threshold current, it is deemed unacceptable as indicated by region "U", and a "low battery" flag is set in software.

This flag indicates that the batteries have been drained to beneath an acceptable performance standard, and thus should be replaced. The microprocessor sends a signal to the keypad via a cable, so that a suitable audible and/or visual indication is provided to warn the user. For this purpose, a conventional beeper 1102 and a light emitting diode (LED) 1104 are provided in the keypad housing (see schematic illustration in FIG. 11), driven by the lock's FDBK (feedback) signal 11.

Also, in a preferred embodiment, two threshold levels are set. The first level warns the user that the batteries are near the end of their life. When the second level is reached, no further withdrawals of the bolt are permitted after the "low battery" flag is set. Software merely causes the microprocessor to ignore correct entries of the combination and provide an auditory and/or visual indication. Thus, before any attempt to withdraw the bolt when the flag is set, this feature prevents the situation in which the battery does not have enough power to re-extend the bolt after withdrawing it.

An enhancement to this feature of setting a flag involves taking advantage of the ability a battery to "recover" its voltage over time. In embodiments having this enhancement, each open-close cycle involves the current testing described above. When current in three consecutive cycles fall below the threshold current value, a "low battery" warning (such as five sets of double beeps) is provided. When current in three consecutive cycles fall below a second threshold, less than the first threshold, the lock is not permitted to operate, and a "dead battery" indication, such as twenty consecutive beeps) is provided.

Preferably, at the end of each cycle when the lock is not allowed to operate, the microprocessor initiates a bolt extend operation to ensure that the short time current is flowing during sensing, nut 230 does not move down the screw 216.

Of course, the particular magnitude of current that is chosen as a minimum threshold, and the particular time $t_1$ after activation, vary with several factors. These factors may include: the properties of the batteries, the motor used in the lock, the expected power consumption of operations for which sufficient power is deemed crucial, a subjectively-chosen margin of safety, and so forth. These parameters may readily be determined by those skilled in the art with routine experimentation with a given combination of battery, motor, and functionality, and the details need not be elaborated.

Bolt Position Sensing

The illustrated bolt is provided with a magnet 290 that is illustrated literally in FIGS. 2, 3A, 3B, 4, and schematically as element 690 in FIG. 6. The magnet is used in conjunction with a Reed switch 692 (FIG. 6) that is attached (for example) to the locks circuit board (not shown). As appreciated by those skilled in the art, the closure of Reed switches is governed by proximity to an external magnet. When a magnet is proximate to the Reed switch, the switch is closed, and when the magnet is not proximate to the switch, it presents an open circuit.

In a first embodiment, when the bolt is extended, a magnet on the circuit board is adjacent the Reed switch, and the Reed switch signals the "locked" condition to the microprocessor or microcontroller ($\mu$C). When the bolt is withdrawn into the case, the magnet is not adjacent the Reed switch and the signal is removed, allowing software in the microprocessor to conclude that the lock is unlocked.

In an alternative embodiment, the Reed switch is placed adjacent the magnet's position when the bolt is withdrawn rather than when it is extended, in which case the signal presented to the microprocessor is an "unlocked" indicator. In either embodiment, the microprocessor can cause an audible and/or visual indicator to be displayed, to confirm a "locked" condition or (preferably) to warn of an "unlocked" condition. In a preferred embodiment, the audible and visual indicators are the beeper 1102 and LED 1104 on the keypad unit (illustrated schematically in FIG. 11).

Push-Pull Embodiment

A second embodiment of the inventive lock, which may be summarized as a "push-pull" embodiment, is shown in FIGS. 8, 9, 10A, 10B, and 10C.

Figure 8:
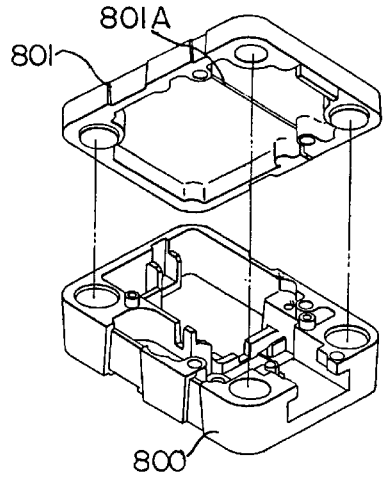
FIG. 8 is an exploded perspective view of a lock case 800 with cover 801, according to a push-pull bolt lock according to a second preferred embodiment of the present invention.
Figure 9:
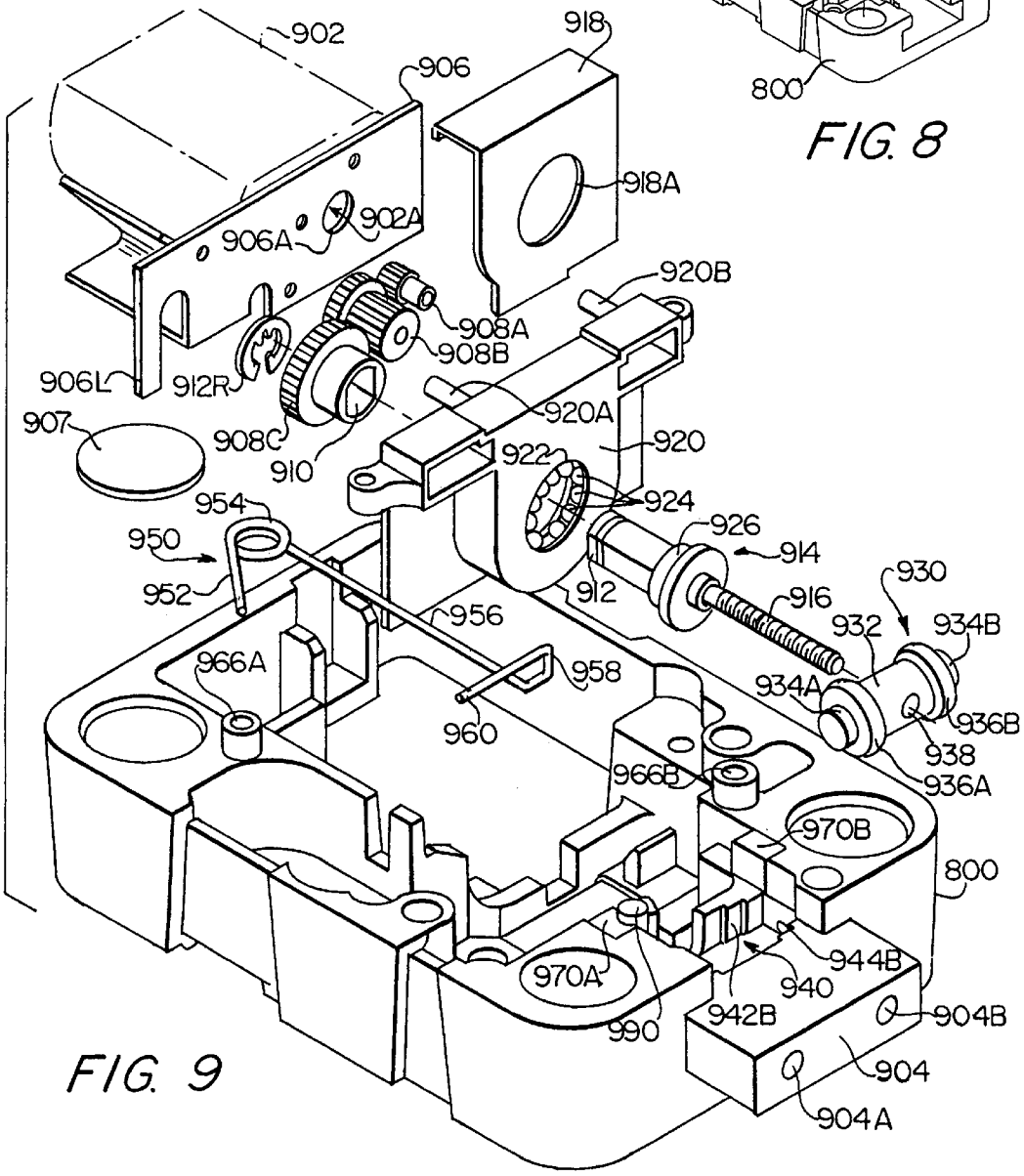
FIG. 9 is an exploded perspective view of certain important mechanical components according to the second embodiment, the push-pull lock.
Figure 10A:
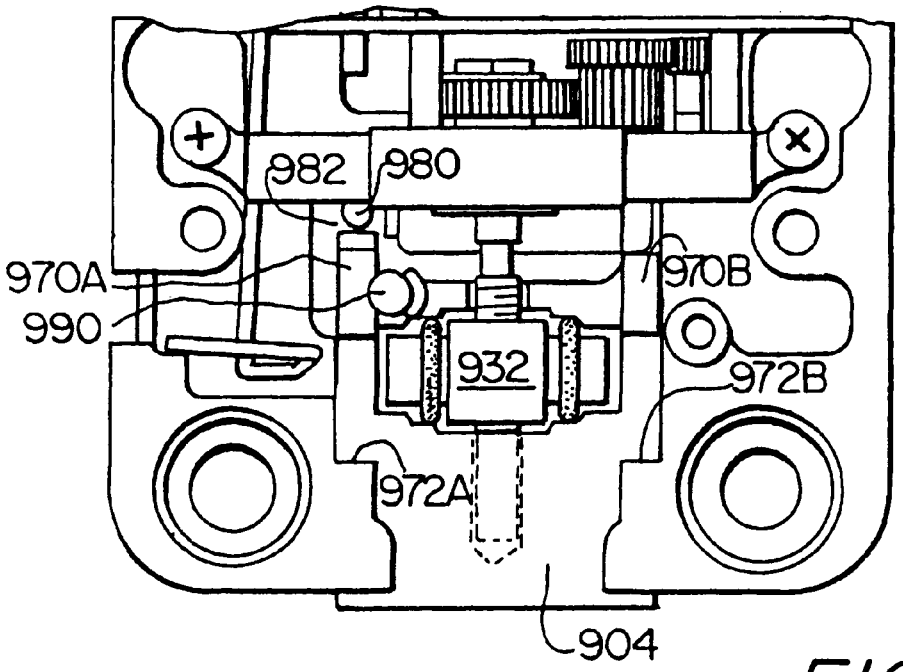
FIG. 10A is a partial cutaway plan view of the lock of FIG. 9 with the bolt in its withdrawn (unlocked) position.
Figure 10C:
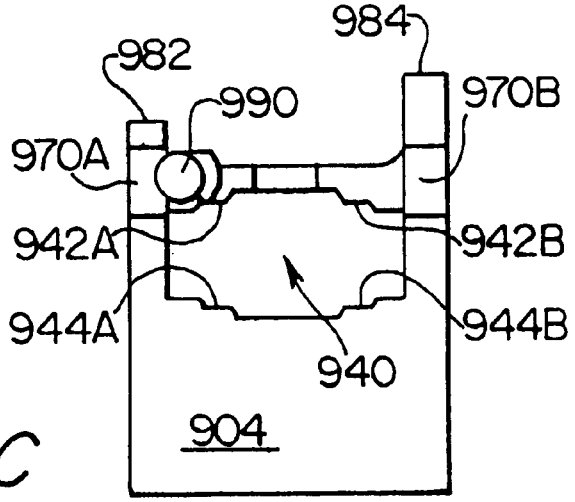
FIG. 10C is a plan view showing features of the bolt 904 of FIGS. 9, 10A and 10B.
Figure 10B:
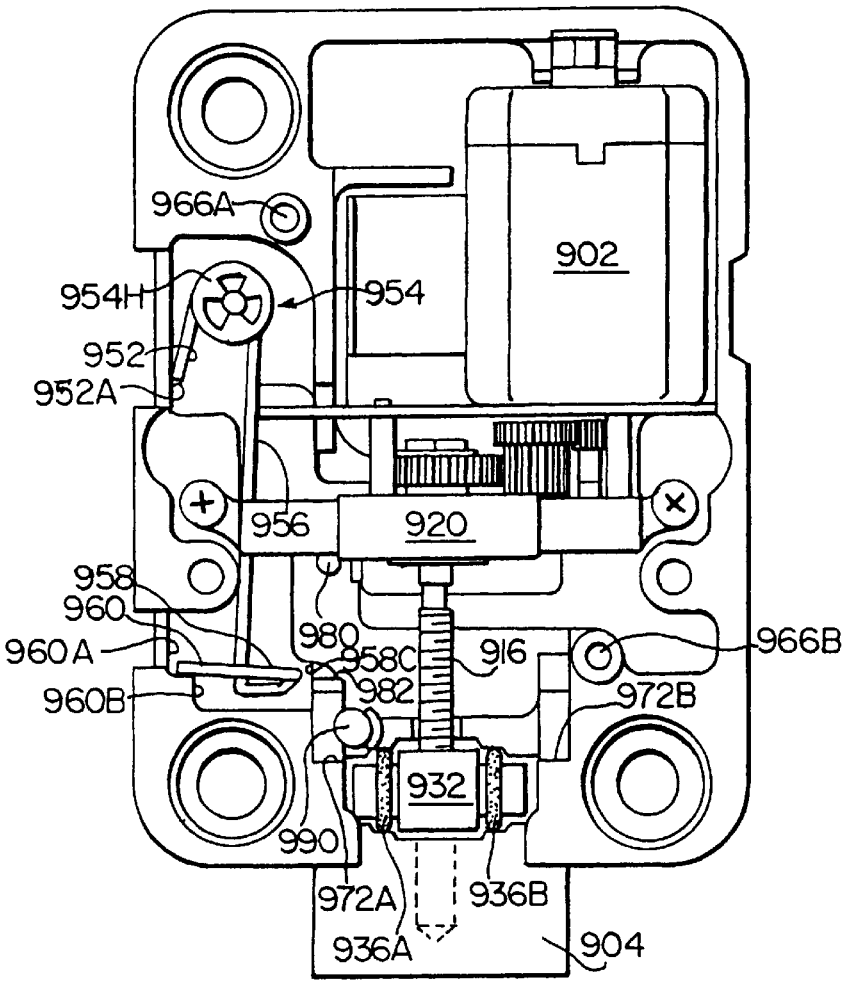
FIG. 10B is a partial cutaway plan view of the lock of FIG. 9 with the bolt in its extended (locked) position.

FIG. 9 is an exploded perspective view of the push-pull lock, with FIGS. 10A and 10B showing partial cutaway plan views of the lock in withdrawn and extended positions, respectively. The components in FIGS. 9, 10A and 10B are enclosed within a case having a base 800 and cover 801 shown in FIG. 8.

A motor 902 provides the motive force to extend bolt 904 into and out of the lock case 800. The bolt is provided with two female threaded holes 904A, 904B that are useful for connection to "bolt works" that are described with reference to FIGS. 13A and 13B.

Motor 902 is supported by a motor bracket 906. The motor's hub located at 902A) is captured by hole 906A in the motor bracket. The motor axle drives a series of gears 908A, 908B, 908C through an opening 906A in the motor bracket. The final gear 908C has a shaped hole 910 that mates with an end 912 of a collar 914 that holds a threaded screw 916. The collar 914 fits through an opening 918A in a bearing retainer 918 that mates with a bearing housing 920. Bearing housing 920 has an opening 922 through which the collar 914 fits. Bearings 924 within the bearing housing 920 support the collar on the collar's bearing surface 926.

A nut assembly 930 is arranged with its axis arranged transverse to the axis of rotation of screw 916. Nut assembly 930 has a larger-diameter central portion 932 and two smaller-diameter outer portions 934A and 934B. Two compressible members such as annular rubber cushions 936A and 936B are provided on respective outer portions 934A and 934B, adjacent but not touching the axially outer edges of central portion 932. Preferably, the outer portions have annular indentations (not shown) that mate with the annular cushions to keep the cushions from slipping in the axial direction. The inner diameter of the annular cushions is thus slightly smaller than the outer diameter of the outer portions beside the indentations to keep the annular cushions in place. Preferably, the cylinder is symmetric about a hole 938 through which the screw is threaded.

The nut assembly 930 with annular cushions 936A, 936B fit into a recess 940 in the top of bolt 904. When the motor causes the screw 916 to rotate in a first direction, the surface of the annular cushion 936A presses against side surface 942A (see especially FIG. 10C), and the surface of the annular cushion 936B presses against side surface 942B. Conversely, when the screw is rotated in the opposite direction, the surface of the annular cushion 936A presses against side surface 944A (FIG. 10C), and the surface of the annular cushion 936B presses against side surface 944B.

A relocker wire, generally indicated as element 950, includes a leverage end 952 that presses against an inner surface 952A of the case (FIG. 10B), a spring 954 (stabilized in the case by a hub 954H in FIG. 10B), a longitudinal portion 956 extending generally toward a point adjacent the bolt, a loop 958 situated near the bolt's inner end surface 982 when it is extended, and a blocking end 960 that normally fits within a notch 960A (FIG. 10B) in the case. The operation of the relocker wire is described below.

A printed circuit board (not shown) is attached to the case 800 at points 966A and 966B. The hardware that is present on the printed circuit board may be substantially the same as that provided on the printed circuit board in the embodiment of the dead bolt lock that has been described above. It should include a control element such as a microprocessor or microcontroller that executes instructions that control operation of the motor, as well as other control and monitoring functions described elsewhere in this specification.

In operation, assuming the lock is in its extended position shown in FIG. 10B, the microcontroller on the printed circuit board responds to entry of a correct authorization signal (such as a sequence of numbers entered on a keypad), and causes the motor 902 to rotate the screw 916 in a first direction. The screw's rotation causes nut assembly 930 to move toward the motor, pressing the rubber cushions 936A, 936B against side surfaces 942A, 942B, respectively, in the bolt's recess 940. This pressure causes the bolt to be withdrawn into the lock case until bolt surface 982 meets a stub from bolt throw adjustment screw 980 that protrudes through the case.

At this time, the motor current rises in response to the increased load, a rise that the microcontroller senses in a suitable manner (see, for example, FIG. 6). When the microcontroller senses the current rise, it commands the motor to stop turning. Advantageously, the annular cushions 936A, 936B absorb much of the shock of impact, thereby reducing the severity of the current rise and allowing the microcontroller to quickly react, thereby preventing damage to the motor, gear teeth and other drive components, and slowing battery depletion.

To re-lock the lock by extending the bolt, the motor rotates in the opposite direction, causing the screw also to rotate in the opposite direction. The screw's rotation forces (or attempts to force) the bolt out of the lock, from its FIG. 10A position toward its FIG. 10B position. When this force is applied to the nut assembly, the annular cushions 936A, 936B press against side surfaces 944A, 944B, respectively, in the bolt's recess 940. If the bolt is not physically blocked, this pressure extends the bolt out of the lock case until bolt protrusions 970A, 970B contact case blocking surfaces 972A, 972B, respectively (see FIG. 10B).

At this contact, the motor current rises, a rise that is sensed by the microcontroller, which responsively cuts power to the motor. In the same manner as during withdrawal of the bolt, the annular cushions absorb much of the shock when the bolt stops, allowing the microcontroller more time to cut power and extend longevity of the motor, gear teeth and other drive components.

If the bolt is physically blocked, the lock functions in much the same manner except that the barrier that blocks the bolt, rather than case surfaces 972A, 972B, determines when the bolt's motion is stopped and the motor is turned off.

Thus, the lock shown in FIGS. 9, 10A, and 10B moves the bolt positively in both directions based on rotation of the motor, and stops moving the bolt in both directions based on current sensing. This functioning gives rise to the term "push-pull" that is applied to the lock.

Although the bolt can be caused to remain in the withdrawn position (FIG. 10A), in the preferred embodiment a "timeout" feature is provided, similar to that described with reference to the dead bolt lock. Briefly, the timeout feature is a security feature that ensures that the microcontroller automatically re-extends the bolt (FIG. 10B) a short time (e.g., fifteen seconds) after the bolt is withdrawn (FIG. 10A). This security feature ensures the bolt is not left for extended periods of time in the withdrawn position (FIG. 10A), possibly giving the impression that the safe is locked when it is in fact not locked.

A preferred application of the push-pull lock is in a lock system in which "bolt works" are employed, as shown in FIGS. 13A, 13B. When used in that application, the push-pull lock can extend the bolt in response to a single user motion (the rotation of the handle shown in FIGS. 13A, 13B). The microcontroller responds to the position of a switch that indicates whether the safe's bolts (bosses 1341–1343) have been moved to their extended position, and extends the lock's bolt automatically.

One or more screw holes (such as that indicated as element 980) are provided through the back of case 800. When a screw is inserted through screw hole 980, the lock operates in the manner described immediately above.

However, when the screw is removed from hole 980, it cannot interrupt the motion of the bolt so that the bolt can be withdrawn into the case to a maximum extent. With no screw installed, the bolt is withdrawn to a position at which bolt surface 984 (FIG. 10C) is blocked by bearing housing 920, at which time the microcontroller cuts power to the motor, with the bolt being slightly withdrawn into the lock case.

A purpose of the screw hole 980 is to adapt the range of motion of the bolt to suit particular installations and geometries of bolt works. In this manner, essentially the same lock (including or excluding an easily-installed and easily-removed screw) can be used in a variety of installations and bolt work geometries. Accordingly, separate locks do not have to be designed and built, thus saving design and fabrication costs for the lock designer and manufacturer.

Also shown in FIGS. 9, through 10C is a magnet 990 whose purpose and function are substantially the same as magnet 290 in the dead bolt lock of FIG. 2. The magnet is shown generically as element 690 in FIG. 6. Thus, this bolt extension and/or bolt withdrawal indicator arrangement including magnet 990 is also employable in the push-pull lock, as are the low battery sensing feature, the tamper-evident keypad, the duress junction box, the remote enable/disable box, and the audit trail indicator that are described elsewhere in this specification with reference to FIGS. 6 and 11.

Second Re-Locking Security Feature (Disclosed with the Push-Pull Lock)

The illustrated embodiment is provided with an integrated re-locking feature that ensures that the bolt is prevented from being withdrawn after certain types of physical attack.

Referring to FIG. 9, motor 902 is fitted into metal motor bracket 906. Relocker wire 950 is spring-biased so that, under normal operation, the relocker wire presses against a bottom portion 906L of metal motor bracket 906. In normal operation, the motor bracket is held in place by pegs 920A, 920B extending from piece 920. The pegs 920A, 920B are made of a material that is substantially weaker than the metal motor bracket 906. Normally, the pegs hold the bracket in place, so that the metal relocker wire 950 remains in its resting position in which the bolt 904 is not blocked (see FIG. 10B).

The effectiveness of this drill-resistant system is enhanced by providing a hard plate 907 that will not begin to form chips during a drilling operation at a force less than will trigger the re-locker arrangement. When external force is applied against the back of the case, or when a drill bit penetrates the case and applies force against the hardened plate 907, then motor 902 and motor bracket 906 are forced away from the back of the case. In this event, the force applied to the metal bracket 906 breaks the soft plastic pegs 920A, 920B that had retained it, allowing the bracket 906 to move unhindered away from the back of the case 800.

As the motor bracket moves away from the back of the case, the bracket no longer retains the spring-biased relocker wire 950. Under the force of spring portion 954, the relocker wire 950 moves away from its resting position near the side 952A of the case. Loop 958, near the outward end of the relocker wire, moves away from the side of the case into a cove 958C in which the relocker wire blocks bolt 904 from being withdrawn. When moved into cove 958C, the relockees loop 958 blocks bolt surface 982. This position of the relocker wire performs a dead bolting function: the bolt cannot be withdrawn, even if a correct combination is entered.

As an additional relocking insurance when force is applied against the motor, the spring portion 954 dislodges outer end 960 of the relocker wire from its resting position in slot 960A in the case. As loop 958 is moved to cove 958C to block bolt 904, end 960 is moved into a position that abuts a ridge 960B (FIG. 10B) in the case. This motion of end 960 is ensured by torsion in loop 958 that biases end 960 to rotate counter-clockwise (as viewed in FIG. 10B). When the end 960 abuts the ridge 960B, no force applied against the relocker wire in a direction away from the bolt (toward the side of the case, from right to left in FIG. 10B) can budge the relocker wire out of its bolt blocking (dead bolt) position. The ridge blocks motion of the relocker wire in any attempt to move the wire back toward the side of the case to its original position 960A.

With this arrangement, an unauthorized individual cannot manipulate the relocker wire out of its bolt blocking position by merely attempting to force the relocker wire away from the bolt. The ridge 960B provides a dead locking feature for the wire that itself provides a dead locking feature to the bolt, effectively providing a second layer of protection.

In addition, the lock cover 801 has a thin section 801A (FIG. 8) that constitutes a break-line in the cover. If the lock motor is forcibly driven from the lock, the cover 801 will break. A portion of the cover will remain over the bolt and wire re-locker, protecting them from further manipulation by individuals trying to defeat the re-locker system.

Auxiliary (System) Features

Figure 11A:
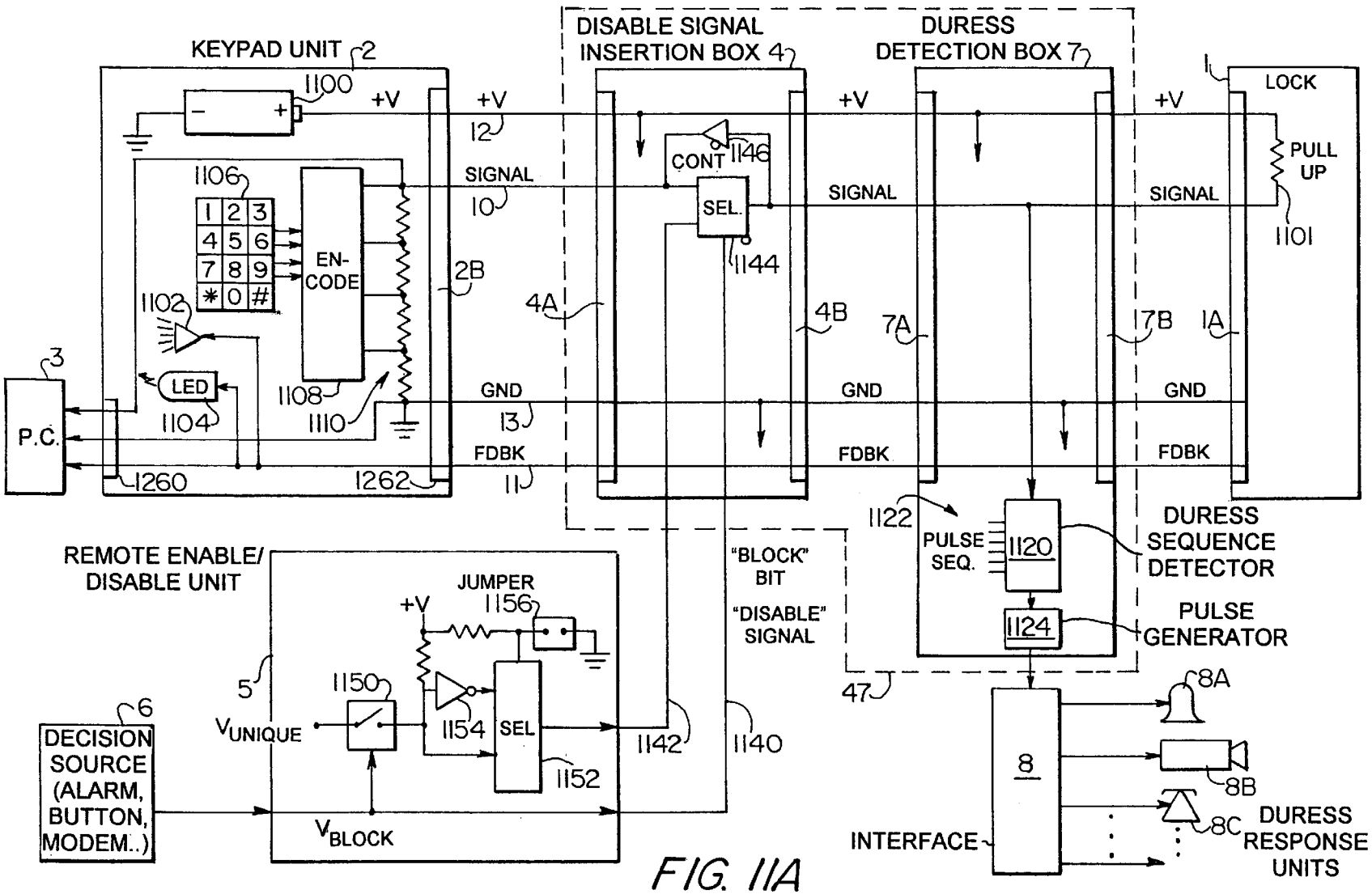
FIG. 11A schematically illustrates a lock system according to an embodiment of the invention, including keypad unit 2 and a lock 1, in conjunction with elements for performing such functions as duress detection, remote enabling and disabling, audit trail generation, keypad tampering response, and bolt extension indication.

Next, various features of the inventive lock system are disclosed, with special reference to FIGS. 11A and 11B (which may be collectively referred to as FIG. 11). It is understood that the system shown in FIGS. 11A and 11B, much like FIGS. 6 and 7, can employ either the dead bolt lock of FIGS. 1–5C, or the push-pull lock of FIGS. 8–10.

A lock 1, which may be of the types described elsewhere in this specification, is shown in conjunction with a keypad unit 2. Lock 1 and keypad unit 2 are connected by a cable that, in a preferred embodiment, has four conductors:

1. A signal line 10 is a bidirectional analog signal path extending between the keypad unit and a microprocessor in lock 1.
2. A feedback line 11 is an analog signal path leading from the lock's microprocessor to the keypad and out to an external data processing unit 3 such as a personal computer.
3. Power, provided by a battery or battery array in the keypad unit, carried on line 12.
4. Ground, shared among the various units, carried on line 13.

Along the cable, one or more modular boxes may be inserted. According to the invention, these boxes include a disable signal insertion box 4 and a duress detection box 7. Boxes 4, 7 are modular, and thus may be included in or excluded from any particular system, although, for completeness in this description, both boxes are included in the illustrated embodiment. Also, the invention provides that the components of boxes 4 and 7 may be combined to share a single box 47.

To support modularity, the boxes are provided with respective input connectors 4A, 7A that allow connection to the cable upstream, and respective output connectors 4B, 7B that allow connection to the cable downstream. If a given box is omitted from the lock system, the cable upstream merely fits into a successive downstream connector rather than into the connector of the box that is omitted. Such connectors are omitted from the FIG. 11B illustration for the sake of clarity. The particular choice or design of the connector lie readily within the ability of those skilled in the art and accordingly a detailed description thereof is omitted.

The duress detection box 7 is shown connected via a communication line to a suitable interface 8 to one or more duress response units 8A, 8B, 8C, and so forth. The duress response units may include, for example, one or more of an alarm 8A, a still or video camera 8B, an external telephone connection 8C, and the like.

Disable signal insertion box 4 is shown schematically as connected via a communication line to a remote enable/disable (RED) unit 5. The operation of the remote enable/disable unit 5 may be governed by a decision source 6 that may be one or more of an alarm button, a key switch, a modem receiving remote electronic commands, and the like.

Briefly, the remote enable/disable unit 5 allows the disable signal insertion box 4 to inject a "disable signal" on the signal line 10 leading to lock 1. In a particular preferred embodiment (see FIG. 11B), the "disable signal" may actually be the "opening" (disconnecting, or open-circuiting) of signal line 10 by a relay; the lock recognizes the open signal line as a disable signal.

In a preferred, simplified embodiment, the functions of elements 4 and 5 are combined in a single box. In that embodiment, when a $V_{block}$ signal is received the composite box with the combined functions of illustrated boxes 4 and 5, the signal line 10 is opened with a suitable latching relay.

The keypad unit 2 includes a key array 1106 and an encoder 1108 that interprets closure of keys in the key array. As illustrated schematically in FIG. 11A, the encoder controls the overall resistance of a resistor ladder 1110 having a series of resistors whose resistance values may be related to each other, for example, by progressively greater powers of 2. The resistor ladder 1110 is connected at one end to ground 13 and at the other end to DC power (+V) 12 by a pull-up resistor (preferably a 20 KΩresistor 1101 located in the lock). In this manner, key array 1106, encoder 1108, and resistor ladder 1110 function together as a programmable voltage divider. By selectively shorting out a given combination of resistors in the ladder, the encoder causes the resistor ladder to present a voltage on the analog output line 10 that is a unique encoded representation of the key that has just been pressed.

In the alternative embodiment of FIG. 11B, an array of resistors 1110' is provided. Each key in the keypad 1106 is connected to a switch (schematically illustrated as element 1108') that inserts a different resistance from into the signal (data) line 10.

The keypad unit 2 is also adapted to receive signals on the analog FDBK (feedback) path 11. In the FIG. 11A embodiment, the keypad unit passes the signals to an external unit 3, such as a conventional personal computer (PC). In the FIG. 11B embodiment, signal and feedback paths are connected to an audit trail interface 3', which includes a Dallas Semiconductor™ "Touch Memory" and an electric circuit to properly translate lock data. Also responsive to the feedback path signal 11 are an audible indicator (beeper) 1102 and a visual indicator (light emitting diode, LED) 1104.

Power is provided to the various illustrated units by a DC power source, schematically indicated as element 1100, which may constitute one or more conventional nine-volt alkaline batteries connected in parallel.

Figure 12A:
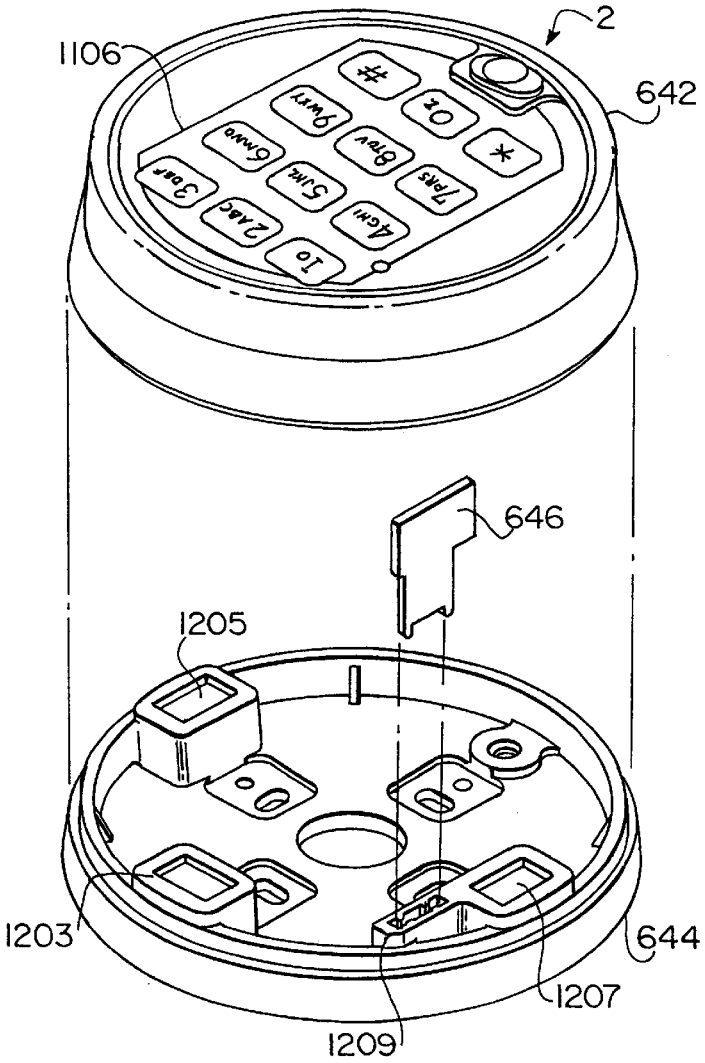
FIG. 12A is an exploded perspective view of a keypad cover 642 and base 644, with a metal piece 646 used in a keypad tampering response system according to an embodiment of the invention.
Figure 12B:
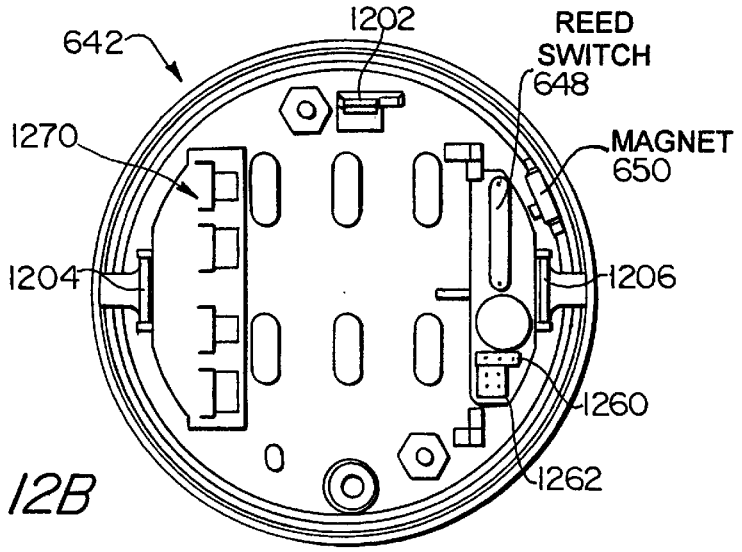
FIG. 12B a plan view of the interior of the cover.
Figure 12C:
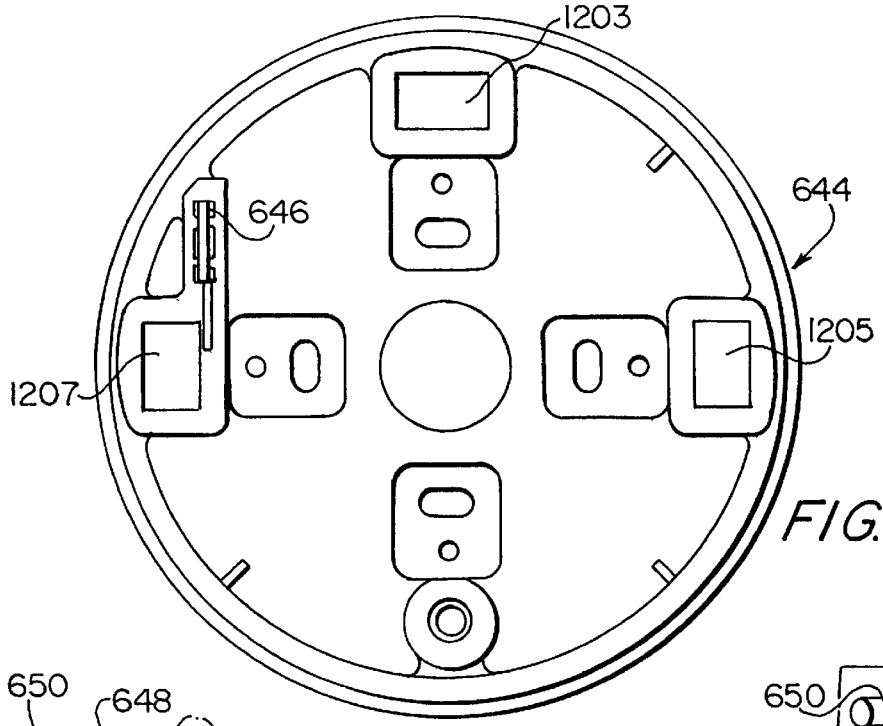
FIG. 12C is a plan view of the interior of the base.
Figure 12F:
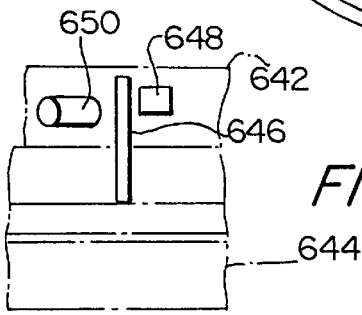
FIG. 12F shows how, when the cover is installed on the base, the metal piece 646 is situated between the magnet 650 and Reed switch 648.
Figure 12E:
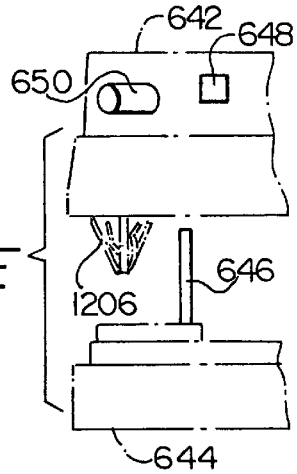
FIG. 12E shows the base and cover poised for installation.
Figure 12D:
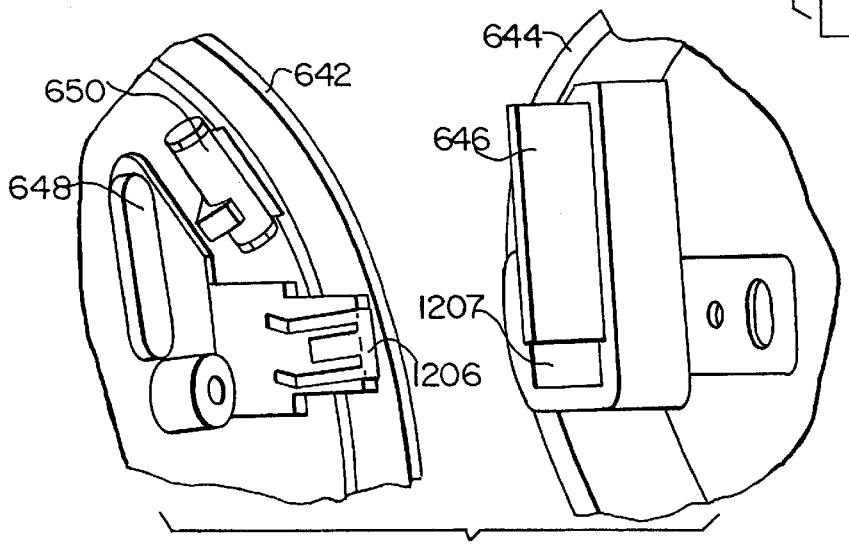
FIG 12D illustrates the base's metal piece 646 juxtaposed with the cover's Reed switch 648 and magnet 650.

Keypad tampering response feature. Referring now to FIGS. 12A–12F, FIG. 12A is an exploded perspective view of a keypad cover 642 and base 644, with a metal piece 646 used in a keypad tampering response system according to an embodiment of the invention. FIG. 12B is a plan view of the interior of the cover 642, and FIG. 12C is a plan view of the interior of the base 644. FIG. 12D illustrates the base's metal piece 646 juxtaposed with the cover's Reed switch 648 and magnet 650. FIG. 12E shows the base and cover poised for installation, and FIG. 12F shows how, when the cover is installed on the base, the metal piece 646 is situated between the magnet 650 and Reed switch 648.

Cover 642 that has a key array 1106. Base 644 is adapted to be fixed to a door or wall by screws, bolts or other means. The cover is firmly affixed to the base by suitable means, such as hook 1202 and spring clips on prongs 1204, 1206 (FIG. 12B) that snap into respective slots 1205, 1207 (FIG. 12A) in the base.

The cover 642 has a first electrical connector 1260 for receiving a cable leading between the keypad unit and an external data processing unit 6 such as a microprocessor (see FIG. 11), and a second connector 1262 for receiving a cable leading between the keypad unit 2 and the lock 1. A bank of battery terminals 1270 is also illustrated, and receives (for example) two standard nine-volt alkaline batteries arranged in parallel in a manner known to those skilled in the art. One or more circuit boards, containing a keypad encoder and other auxiliary circuitry may be arranged behind the batteries and connectors.

It is recognized that unauthorized individuals may attempt to gain entry to the protected area, vandalize the lock, or simply gain information about the lock's construction, by removing the cover from the base. A preferred embodiment of the locking system detects when the cover has been removed from its back, and responds in a variety of ways.

The cover has a permanent magnet 650 (see also FIG. 6) placed close to a Reed switch 648 (see also FIG. 6). The base has a metal piece 646 fixed in a slot 1209 (FIG. 12A). When the cover is installed on the base, the base's metal piece 646 (FIG. 12A) is situated directly between the cover's magnet 650 and Reed switch 648 (FIG. 12B). When the cover is thus installed on the base, the metal piece attracts the flux lines that would otherwise reach the Reed switch. In this situation, the Reed switch is in a first state.

Conversely, when the cover 642 is removed from the base 644, the metal piece 646 is removed from between the magnet and Reed switch. In this situation, the flux lines from the magnet that were previously diverted by the metal piece are allowed to reach the Reed switch, causing the switch to change from its first state to an opposite, second, state.

The Reed switch is connected by the signal line leading from the keypad unit to a microprocessor or microcontroller ($\mu$C) (see FIG. 6). In a preferred embodiment, the microcontroller is located on a printed circuit card that is located safely in the lock case, remote from the keypad unit. The state of the Reed switch is read by the microprocessor, either substantially continuously, or via a suitable interrupt scheme. When the software in the microprocessor detects that the cover has thus been opened, it can initiate any of a variety of functions in response to removal of the keypad cover, as follows.

First, the microprocessor can merely record the occurrence in its log of occurrences in a EEPROM (electrically erasable programmable read-only memory), which may be an on-chip memory that is part of the $\mu$C or a separate memory chip. The occurrence becomes part of the audit trail that is discussed elsewhere in this specification. The audit trail may be uploaded to a personal computer or other device, through the keypad housing, in response to entry of a predetermined "upload" key sequence.

Alternatively, the removal of the metal piece 646 from between the magnet 650 and Reed switch 648 can cause the Reed switch to ground the signal line leading from the keypad unit to the lock. (Alternatively, it is envisioned that the signal line can be set to a predetermined "tamper alarm" voltage level, other than ground and unique from voltages that are generated by pressing keys on the keypad.) The lock's microprocessor software interprets a grounded signal line or other "tamper alarm" voltage as a disable signal, and refuses to withdraw the lock's bolt. As long as the "tamper alarm" signal is asserted, even a correct combination entry does not reach the lock.

Should the cover be replaced on the base, the Reed switch returns to its first state, and the "tamper alarm" voltage is removed from the signal line leading to the lock. The lock can respond in various ways. For example, the lock may merely return to normal operation, on the theory that the cover has been removed for legitimate reasons (such as to replace the batteries in the keypad housing).

Alternatively, the lock can continue to refuse to open the bolt, even in response to a correct combination entry, on the assumption that the person removing the cover is not authorized. In this alternative scenario, the lock software has set a "keypad tamper" flag, preferably in EEPROM, in response to the original removal of the keypad cover. After the cover is replaced and additional combination entries are made, the software sounds an audible and/or visual alarm to indicate to the current individual that tampering has occurred. After a single such warning, or (alternatively) after the user has entered a special code sequence to acknowledge and remove the "tamper alarm" condition, the lock's microprocessor resets the "keypad tamper" flag and returns to normal operation.

In the foregoing manner, the inventive lock embodies a variety of responses to detected tampering. The responses vary in their level of severity, as described above.

Duress Response Feature

The lock system may employ a system that allows a user to secretly signal that he is under duress. For example, when a business employee is held at gun point and is ordered to open the lock, he is considered to be under "duress" as understood in this specification. In this scenario, the employee may enter a special combination, called a duress combination, instead of an ordinary combination. The duress combination may be, for example, a one-digit variation of a combination that is ordinarily used to open the lock when the employee is not under duress.

Moreover, the ability of the lock to send duress signals is turned on and off by a predetermined keypad programming sequence. The combination that is a duress combination is recognized as a duress signal only when the feature is turned on.

When a duress combination is entered, the lock itself may respond normally, as if a correct combination has been entered, and no special feedback is provided on the analog feedback line. This ensures that the gunman is not alerted to entry of the duress combination. However, the lock detects entry of the duress combination, and signals the duress response unit(s). The employee thus can comply with the gunman's demand to open the lock without alerting the gunman that he is, by doing so, sounding an alarm, activating a camera, calling for police assistance, and the like.

To achieve this function, a modular duress detection box 7 is inserted in line between the keypad unit 2 and the lock 1. Essentially, the lock monitors the analog signal line 10 and compares a sequence of analog voltages levels that are encoded representations of the sequence of keys that the user has pressed. When the lock detects entry of a duress code, the lock sends a unique series of voltage pulses back up the bidirectional signal line. The duress detection box interprets the analog pulse sequence from the lock, and in response, closes an output relay that signals an alarm condition. In a particular preferred embodiment, the relay changes state one second after the duress code is input, and stays in that changed state for two seconds.

This monitoring arrangement is schematically indicated by a shift register-comparator 1120 that receives the sequence of voltage pulses and compares them to a known pulse sequence 1122. When a complete match is detected, the shift register-comparator signals a pulse generator 1124 (most simply embodied by the relay mentioned above) that responsively signals the interface 8 to the duress response unit(s).

When the interface 8 receives the signal, it causes the one or more duress response units to respond appropriately, such as by sounding a (generally remote) alarm, activating a video or still camera to gather evidence of the robber and robbery, and/or to automatically telephone the police to warn them of the robbery in progress.

In this manner, the inventive lock system enables the business owner to take appropriate action(s) against a robber without alerting the robber that he has done so.

The particular choice or design of the interface varies in accordance with the particular response unit(s) that are chosen. Because the particular choice of such unit(s) and the particular choice or design of the interface is not essential to the invention, and because such choice or design lie within the ability of those skilled in the art, detailed discussion of the interface's construction is not necessary.

Remote Enable and Disables

The disable signal insertion box 4 and the remote enable/disable ("RED") unit 5 allow a business owner to remotely disable the lock from being opened, even when a correct combination is entered at the keypad unit 2.

Exemplary embodiments of this box and unit are illustrated schematically in FIG. 11A. However, in a particular concrete embodiment, a box that is a combination of box 4 and unit 5 receives an external voltage signal $V_{block}$ that determines whether or not the lock is to be allowed to operate. An optical coupler receives $V_{block}$ and, depending on the setting of jumpers that essentially determine a polarity convention, a latching relay either closes or opens the signal line 10 between the lock 1 and the keypad unit 2. The +V power line 12 is not interrupted so that the lock can still automatically re-lock, regardless of the state of $V_{block}$.

Referring again to the more generalized, schematic illustration in FIG. 11A, the disable signal insertion box 4, under control of the remote enable/disable (RED) unit 5, interrupts the analog signal line 10 so that signals from the keypad unit 2 are prevented from reaching the lock. When the disable feature is active, instead of the analog signal from the keypad, a "disable" signal (an analog signal in the preferred embodiment) is sent to the lock. A binary (yes/no) decision is made, indicated schematically by a binary "block" bit signal 1140. A "block" signal, shown schematically as a binary voltage $V_{block}$ issued by a decision source 6, is input to both the disable signal insertion box 4 and the RED unit 5.

In the disable signal insertion box, the "block" bit 1140 controls the select control input to a multiplexer, schematically illustrated as element 1144. When active, the "block" bit causes a "disable" signal 1142 from the RED unit 5 to pass to the lock 1. When the "block" bit 1140 is not active, the selector 1144 merely passes the analog signal from the keypad unit 2 to the lock 1 to carry on normal operation.

The selector 1144 is shown schematically, and is understood to have an output with a high impedance state. When in the high impedance state, the selector does not interfere with signals passing from the lock back to the keypad. For passage of signals in this reverse direction, a buffer with a high-impedance output and a control input is also illustrated schematically as element 1146.

In the alternative embodiment of FIG. 11B, interruption of the signal line is accomplished by opening a relay on the signal line rather than by selecting a non-interruptible voltage to put on the signal line.

Referring again to FIG. 11 A, In the RED unit 5, the $V_{block}$ signal controls a switch that is schematically indicated as element 1150. When activated, switch 1150 selectively connects a voltage $V_{unique}$ to the first input of a selector 1152. When $V_{unique}$ is a digital signal, an inverter 1154 is provided to receive the output of switch 1150, and drives the selector's second input. $V_{unique}$ may be an analog signal or a digital signal, depending on the particular embodiment chosen, as follows.

If $V_{unique}$ is designed as an analog signal, the selector's first input is always selected and $V_{unique}$ is sent through the disable signal insertion box 4 to reach the lock 1. In this case, $V_{unique}$ functions as a disable signal 1142 that instructs the lock to ignore any attempted combination entries made at the keypad. $V_{unique}$ must be unique with respect to the voltages that are generated by the keypad unit's voltage divider 1110, so that the lock can readily distinguish the analog $V_{unique}$ disable signal 1142 from ordinary key closures on signal path 10.

If $V_{unique}$ is a binary signal (such as ground), selector 1152 passes either $V_{unique}$ (probably ground) or its inverted binary signal (near +V) as the selected disable signal to the disable signal insertion box. For flexibility, a manually-set jumper connection 1156 determines whether $V_{unique}$ or its inversion is selected. The (binary) disable signal 1142 instructs the lock 1 to ignore keypad combination entries in the same manner described immediately above, in the paragraph premised on $V_{unique}$ being an analog signal.

The use of a digital $V_{unique}$ may be considered to be simpler and more reliable than use of an analog $V_{unique}$. Indeed, if a binary disable signal is used, the disable signal insertion box 4 can be designed as a simple electrical relay that controllably grounds the signal line 10, thus simplifying the design and implementation of the lock system over the selector 1144 implementation that is schematically illustrated.

However, a scenario is envisioned that makes the use of an analog disable signal more desirable than a binary disable signal. In particular, in some embodiments, the keypad unit 2 is provided with a particular tamper detection feature that grounds the analog signal line 10 in response to detected keypad tampering. In this scenario, if $V_{unique}$ were binary, the lock would receive a ground signal on the analog signal line 10, but could not distinguish between keypad tampering (from the keypad unit) and remote disablement (from the RED unit). Use of an analog $V_{unique}$, different from all signals provided by the keypad on the analog signal line 10, avoids this ambiguity.

Audit Trail Features

According to an embodiment of the invention, the lock's microprocessor keeps a log of occurrences. Preferably, the log is kept in an electrically erasable programmable read-only memory (EEPROM) provided on the same circuit board as, or as an integral part of, the microprocessor. To simplify the data structure and to maximize use of the EEPROM's memory capacity, the log is preferably kept as a "rolling stack" of $2^n$ entries (where n is an integer such as, for example, 6).

Various occurrences are entered into the log. Occurrences that are entered may include as correct combination entries, incorrect combination entries, as well as more unusual events such as keypad tampering warnings, duress combination entries, and remote enablements and disablements. With each occurrence, a binary code sequence that uniquely identifies the occurrence is pushed onto the stack.

When the EEPROM's capacity is exceeded (which might otherwise correspond to a stack overflow in a conventional stack), the oldest occurrence is merely overwritten. This design thus avoids stack overflows, an especially useful feature when small-capacity EEPROMs are used.

When it is desired to read the log, a user enters a predetermined "upload" code sequence at the keypad. The lock's microprocessor detects this upload sequence, and takes control of the analog signal line 10 and the analog feedback line 11. The microprocessor places a synchronizing clock signal on the feedback line 11 while placing data on the signal line 10 in synchrony therewith. The transmitted data are merely the code sequences that are popped from the stack. The clock and synchronous data pass through the keypad unit 2 to an external device 3, which may be a personal computer (PC) or a suitable interface that conditions the data for entry into a PC.

In this manner, the most recent occurrences recorded by the lock are synchronously transmitted to the audit module's microprocessor (FIG. 11B), or the coded sequence of occurrences are communicated to an external computer 3 (FIG. 11A) for display and auditing by individuals. The hardware and software implementation of a rolling stack, the generation of clock and data signals in synchronization therewith, the relaying of the information to the external computer, and the presentation of the log information, are readily chosen or designed by those skilled in the art and need not be further discussed.

FIG. 11B illustrates an alternative embodiment that performs substantially the same functions that are performed by the embodiment of FIG. 11A. Identical and similar elements are given identical and similar reference numerals, with the understanding that elements from one of FIGS. 11A and 11B may interchanged with elements from the other of FIGS. 11A and 11B. That is, the embodiments of FIGS. 11A and 11B are not mutually exclusive.

Referring to FIG. 11B, a keypad unit 2' is shown connected to a lock 1' by a series-connected remote enable module 4' and a duress module 7+. It is envisioned that remote enable module 4+ and a duress module 7+ may be included in a single module 47' to provide the same functionality. An audit trail interface 3' is located on a branch of the cable between the keypad unit and the lock.

Also in FIG. 11B, an external alarm system 58', which may be any of a variety of commercially available alarm systems, is provided. The external alarm system receives a duress input from duress module 7'. The external alarm system also provides an "enable" signal to the remote enable module 4'. The external alarm system may be of the type that provides signals to a variety of alarm response units, such as an audible alarm 8A, a camera 8B, and the like.

In the keypad unit 2'in FIG. 11B, power is provided by a power source 1100 such as the remote enable module 4', the duress module 7', the lock 1', and the audit trail interface 3', or to as many of these elements as a present in a given implementation. A beeper 1102 and an LED 1104 are connected to the feedback (FDBK) line 11 from the lock 1' in the same manner as in FIG. 11A.

Key closures in keypad unit 2' (FIG. 11B) are communicated in a slightly different manner than in keypad unit 2 (FIG. 11A). In FIG. 11B, each of twelve keys on a keypad array 1106 operates a respective key switch in a keypad key switch array, generally indicated as element 1108'. When a key is pressed, the corresponding switch closes, connecting the signal line 10 to ground 13 via a corresponding resistor in a resistor network 1110'. Because each resistor has a unique resistance value, the resistance introduced between signal line 10 and ground is unique for each key closure, allowing the lock's microprocessor to uniquely differentiate key closures.

The remote enable module 4' in FIG. 11B essentially allows an external decision source, such as external alarm system 58', to break the electrical connection along signal path 10. In the illustrated embodiment, the electrical connection is selectively opened and closed by the state of a latching relay 1147. The state of the relay 1147 is determined by the state of a binary "enable" signal that is provided on path 1140' from (for example) the external alarm system.

The "enable" input passes through an optocoupler 1149, and a resulting isolated "enable" signal is input to a microcontroller 1148. Microcontroller 1148 stores the state of the enable signal in the same manner as a register or latch. For added flexibility in interfacing to levels of different commercial external alarm systems 58', a polarity input 1150 tells the microcontroller whether a high or low level from the isolated "enable" signal indicates an "enable" instruction. The polarity signal can be determined by a hand-set jumper selectively connecting the polarity signal line to either voltage or ground. The "enable" signal determines whether the signal line 10 should be open or closed.

Microcontroller 1148 closes the latching relay 1147 when the "enable" signal is activated (for normal lock operation), and opens the latching relay when the "enable" signal is not activated (to disconnect the keypad from the lock). Microcontroller 1148 may be implemented as (for example) a MICROCHIP™ PIC12C508 microcontroller, although alternative implementations lie within the scope of the invention.

Referring now to the duress module 7'in FIG. 11B, a microcontroller 1173 controls the state of a duress relay 1172 in response to a series of duress pulses detected by a comparator 1171. As in the embodiment described above, when an employee is under duress he can enter a special duress key sequence at the keypad 1106. The duress key sequence is different from the normal combination key sequence. The lock recognizes this duress key sequence and sends a series of duress pulses back up the bidirectional signal line 10.

The duress pulses are of a frequency, shape and duration that are different from any key closure sequence coming from the keypad, and different from any expected noise on the line. When comparator 1171 compares the instantaneous voltage on signal line 10 to a threshold voltage, signals below a certain magnitude are ignored. Thus, the comparator effectively filters out signals and noise that might otherwise falsely resemble a duress pulse sequence.

Microcontroller 1173 recognizes any sequence that is passed by the comparator, and detects when pulses of a certain predetermined frequency and duration are present for a required number of cycles. When microcontroller 1173 recognizes an incoming waveform as a duress pulse sequence, it changes the state of duress relay 1172. The state of duress relay 1172 (which may be connected to voltage or to ground, depending on whether it is closed or opened) is communicated along path 1174 to the external alarm system 58'.

The duress condition may be maintained for a length of time appropriate to the application involved. This takes into consideration the requirements of the external alarm system, the possibility of a manual cancelling of the duress condition, and the like. Programming variations of such function into the microcontroller lies within the ability of those skilled in the art.

If remote enable module 4' and duress module 7' are combined into a single combination module 47', microcontroller 1148 and microcontroller 1173 can be implemented using the same microcontroller, such as a MICROCHIP™ PIC12C508.

Referring to the audit trail interface 3' of FIG. 11B, a synchronization signal is input on signal line 10 synchronously with audit data signal on path 11. The audit trial interface 3' includes a microcontroller 1158 that may be of conventional design, such as the same model used in the lock, an SGS Thompson ST62T60B. The synchronization signal and the audit data signal are provided by the lock 1', normally in response to a predetermined sequence of key closures from keypad array 1106.

The microcontroller uses the synchronization input as a clock signal to clock in data on the signal line 10 representing the audit trail information. When the audit data has been read in by the microcontroller, the microcontroller outputs the data to a data storage device 1159 such as the commercially-available DALLAS SEMICONDUCTOR™=0 "Touch Memory" or other suitable memory. The information in the storage device 1159 can be moved from the audit trail interface to a device (such as a PC) that displays the information in a format more easily readable by humans for auditing. As an alternative implementation, the microcontroller 1158 can send the audit date directly to the suitable display device, bypassing the step of storing it in an intermediate storage device 1159.

It is again emphasized that the embodiments of FIGS. 11A and 11B are not mutually exclusive. Rather, features from one of the embodiments may be combined with features from the other embodiment to arrive at a wide variety of implementations. Thus, the scope of the invention should not be limited to the embodiments and implementations that have been described above.

Lock With "Bolt Works"

The dead bolt lock embodiment and the push-pull embodiments are especially suitable for use as locks in a locking system shown in FIGS. 13A and 13B. In those figures, a lock 1 with a bolt 1304 is shown in conjunction with bolt works 1310 that are connected to the bolt. In the illustrated locking system, bolt 1304 itself does not block the door from being opened, but rather the bolt indirectly causes the door to be blocked from opening.

In particular, the bolt 1304 is connected by suitable means such as screws to a blocking member 1312. The blocking member may be of any of a variety of shapes and orientations. The illustrated blocking member is a vertically oriented bar that is biased downward by gravity toward a horizontally-oriented slide bar 1320. If the slide bar 1320 is positioned at or near its rightmost extreme (as viewed in FIG. 13A), the bottom end of the blocking member 1312 is captured in a notch 1322 in the slide bar 1320. When thus captured, the blocking member 1312 prevents the slide bar 1320 from moving horizontally.

If the blocking member is not captured in the notch, the slide bar may be manually moved by means of a lever 1330. Lever 1330 pivots about a pivot point 1332. A pin 1334 in the lever engages a vertical slot 1324 in the slide bar to translate rotation of the lever into longitudinal horizontal motion of the slide bar toward or away from the door jamb (see FIG. 13B).

The end of the slide bar closest to the door jamb is integrally connected with a vertical bar 1340 having one or more bosses 1341, 1342, 1343 that extend outwardly from the door toward the jamb. When the blocking member 1312 is captured in notch 1322 (FIG. 13A), the bosses 1341, 1342, 1343 engage respective reinforced slots in the door jamb so that the slide bar 1320 cannot be moved, and the bosses block the door from opening. When the blocking member 1312 is not captured in the notch 1322, a user can rotate the lever 1330 to move the slide bar 1320, vertical bar 1340, and bosses away from the doorjamb further into the door (FIG. 13B). The extreme extent of this horizontal motion draws the bosses completely into the door, so that they do not block the door from opening.

Thus, whether or not the door is locked, is determined by (1) the horizontal position of the slide bar 1320 (determined by the user's lever) and by (2) the vertical position of the bolt 1304 and blocking member 1312 (as determined by the lock 1).

In a first mode of operation, the lock 1 responds to a correct combination entry by withdrawing the bolt 1304 into the lock case for a given short "timeout period" (such as fifteen seconds), thus causing the blocking member 1312 to escape from the notch 1322 and allowing the user to move the slide bar as in FIG. 13B and open the door. At the end of the timeout period, the lock automatically causes the bolt to extend, thus enabling the blocking member 1312 to be captured by the notch 1322 if the notch is positioned beneath it.

If the notch is not positioned beneath the blocking member, it is recognized that the bolt is blocked from extending. In this event, a spring member, such as first coil spring 208 (FIG. 2) in the dead bolt lock according to the first embodiment, ensures that the blocking member is immediately pressed into the notch when the notch and blocking member become aligned in the future. This feature is more appropriately used with the push-pull lock than with the dead bolt lock due to the latters physical capability to move objects heavier than the bolt itself.

If the push-pull lock of FIGS. 8–10 were used in the system of FIG. 13, and the lock attempted to extend the bolt when the blocking member and notch were not aligned, the bolt could not be extended; the motor would immediately turn off because of the blockage. Accordingly, for use in a second mode of operation, an additional feature of the lock is a sensor switch 1350 that detects whether or not the bosses are inserted into the door jamb.

The sensor switch 1350 is illustrated as being placed in the doorjamb, and is closed by contact with the vertical bar 1340 when the vertically bar is in its extreme extended position (FIG. 13A). However, the invention provides that the sensor switch can also be located in the bolt works, a placement that ensures that blocking member 1312 can freely move into notch 1322.

The invention envisions varied placement of the sensor switch, such as in the door itself, provided it determines the extended or withdrawn position of the slide bar, vertical bar and bosses. However, placement of the sensor switch in the door jamb ensures not merely that the slide bar and bosses are extended, but extended into the doorjamb.

In the second mode of operation, the lock's microprocessor 1 responds to entry of a correct combination (or other authorization) in the same manner as the first mode of operation: by withdrawing the bolt and thus lifting the blocking member 1312 so the user can withdraw the slide bar 1320, vertical bar 1340 and bosses 1341–1343. However, in the second mode of operation, the lock 1 responds to the state of the sensor switch 1350, and attempts to extend the bolt only when the switch verifies that slide bar is fully extended and the bosses are within the door jamb. This second mode ensures that the only time the bolt is extended is when the door is in fact closed and the bosses are in fact blocking the door from being opened. In contrast to the second mode of operation, the first mode of operation leaves the possibility that the user opens the door but extends the slide bar outward, thereby allowing the blocking member to fall into the notch even though the door is still open.

The dead bolt lock of the first embodiment is especially suitable for use in the first mode of operation, and the push-pull lock of the second embodiment is especially suitable for use in the second mode of operation.

Modifications and variations of the above-described embodiments of the present invention are possible, as appreciated by those skilled in the art in light of the above teachings. Thus, the particular implementation of the mechanical, electrical, electronic, functional software, and data structure features of the invention may be varied in accordance with principles possessed by or readily available to those skilled in the art. For example, the invention provides feedback of proper lock operation to the user in any of a variety of ways, not limited to the visual and/or audible bolt extension indication that is discussed in the foregoing specification. It is therefore to be understood that, within the scope of the appended claims and their equivalents, the invention may be practiced otherwise than as specifically described.

What is claimed is:

1. A lock system for protecting an enclosure by locking a door to the enclosure, the system comprising:

a) a lock with a case and a bolt that is extendable out of and withdrawable into the case;

b) bolt works that are integrally formed with or integrally connected to the bolt;

c) door blocking means, whose position a user of the lock system controls, for moving between:

1) a locked position in which the door blocking means is positioned to prevent the door from opening, wherein, when the door blocking means is in the locked position, the bolt works are in a position in which the bolt works can prevent movement of the door blocking means out of the locked position; and 2) an unlocked position in which the door blocking means is positioned so that the door is not prevented from opening;

wherein the door blocking means includes a slide bar;

d) a sensor that provides a signal indicating when the door blocking means is in the locked position;

e) control means, responsive to the signal from the sensor, for automatically extending the bolt and moving the bolt works into the position in which the bolt works prevent movement of the door blocking means out of the locked position, so that a single manipulation by the user of the door blocking means causes both (1) the door blocking means to move to the locked position and (2) the bolt to be extended; and f) a handle that the user manipulates to cause the slide bar to move between its locked position and its unlocked position.

2. The system of claim 1 wherein:

the sensor constitutes a mechanical switch that provides an electrical signal to the control means to indicate when the door blocking means is in the locked position and the door is closed.

3. The system of claim 1, wherein:

the controller includes a microprocessor that is disposed within the lock case and that controls the bolt's position.

4. The system of claim 1, wherein:

the control means controls the position of the bolt, in both withdrawing and extending directions, by moving the bolt until the bolt encounters a blocking resistance, by sensing a resulting current rise in a motor, and by cutting power to the motor.

5. A lock for protecting an enclosure by locking a door to the enclosure, the lock comprising:

a) a lock with a case and a bolt that is extendable out of and withdrawable into the case; and b) control means for controlling the position of the bolt, in both withdrawing and extending directions, by moving the bolt until the bolt encounters a blocking resistance, by sensing a resulting current rise in a motor, and by cutting power to the motor.

6. The lock of claim 5, further comprising:

a) a motor controlled by the control means;

b) a screw that rotates in a first direction or a second direction under control of the motor; and c) a nut member that is threadably engaged on the screw and that is contained within a recess in the bolt, the nut member including:

c1) cushioning means for contacting surfaces of the recess when the bolt impacts a blocking structure and for cushioning a resulting impact before the motor cuts power to the motor.

7. The lock of claim 6, wherein the cushioning means includes:

two annular compressible members arranged symmetrically about the screw on the nut member.

* * * * *